US005974757A

United States Patent [19]

Whitney et al.

[11] Patent Number: 5,974,757

[45] Date of Patent: Nov. 2, 1999

[54] PRIVACY ENCLOSURE

[75] Inventors: Leland R. Whitney, St. Paul; Thomas J. Scanlan, Woodbury; Charles A. Marttila, Shoreview; Ronald W. Gerdes, St. Paul; David W. Schilling, Woodbury; Joseph G. Mandell, Maplewood; Gary N. Harvieux, Woodbury, all of Minn.

[73] Assignee: 3M Innovative Properties Company, St. Paul, Minn.

[21] Appl. No.: 09/163,051

[22] Filed: Sep. 29, 1998

Related U.S. Application Data

[62] Division of application No. 08/623,619, Mar. 28, 1996, Pat. No. 5,813,180.

[51] Int. Cl.[6] ..... E04B 2/08

[52] U.S. Cl. ..... 52/586.1; 52/271

[58] Field of Search ..... 52/586.1, 271, 52/284; 181/285, 290, 291; 403/292, 295

[56] References Cited

U.S. PATENT DOCUMENTS

| | | | |
|---|---|---|---|
| 2,352,807 | 7/1944 | Sheldon | 52/586.1 |
| 2,806,509 | 9/1957 | Bozzacco et al. . | |
| 2,961,478 | 11/1960 | Burns | 52/586.1 |
| 3,074,123 | 1/1963 | Gartrell | 52/586.1 |
| 3,132,956 | 5/1964 | Lewis . | |
| 3,153,692 | 10/1964 | Lindgren . | |
| 3,217,085 | 11/1965 | Lindgren . | |
| 3,246,272 | 4/1966 | Lindgren . | |
| 3,256,384 | 6/1966 | Lindgren . | |
| 3,790,696 | 2/1974 | Lindgren . | |
| 3,982,367 | 9/1976 | Jonsson et al. . | |
| 4,079,162 | 3/1978 | Metzger . | |
| 4,507,520 | 3/1985 | Lindgren . | |
| 4,628,650 | 12/1986 | Parker | 52/269 |
| 4,740,654 | 4/1988 | Lindgren . | |
| 4,794,206 | 12/1988 | Weinstein . | |
| 4,987,706 | 1/1991 | Hughes et al. . | |
| 5,077,241 | 12/1991 | Moh et al. . | |
| 5,197,225 | 3/1993 | Yff . | |
| 5,210,984 | 5/1993 | Eckel | 52/270 |
| 5,274,200 | 12/1993 | Das et al. . | |
| 5,351,453 | 10/1994 | Leslie | 52/270 |
| 5,418,339 | 5/1995 | Bowen et al. | 181/230 |
| 5,658,656 | 8/1997 | Whitney et al. | 428/304.4 |
| 5,813,180 | 9/1998 | Whitney | 52/270 |

FOREIGN PATENT DOCUMENTS

| | | |
|---|---|---|
| 0 664 659 A2 | 7/1995 | European Pat. Off. . |
| 2 649 356 | 1/1991 | France . |
| WO 95/19943 | 7/1995 | WIPO . |

*Primary Examiner*—Michael Safavi

[57] ABSTRACT

Enclosure 1 constructed of panels 20 which can be joined by tongue and groove or press fit spline 46 and groove 26 technique. Acoustic shielding is achieved by properly selected materials of construction, e.g. syntactic, cellular composites.

The doorway 10 of the enclosure is closed by a door 210 penetrated only by a guide 175. The latch mechanism 170 and 340 seals the door against the door jamb 185 by means of cam rollers 316 which engage indentations 189 (which may have specialized cam surfaces or inclined surfaces) along the door frame. The latch mechanism can be actuated from either side of the door by mechanical means engaging the guide.

1 Claim, 22 Drawing Sheets

PRIVACY ENCLOSURE

This is a division of application Ser. No. 08/623,619 filed Mar. 28, 1996, now U.S. Pat. No. 5,813,180.

This invention was made with Government support. The Government has certain rights in this invention.

TECHNICAL FIELD

This invention relates to enclosures or rooms which have been acoustically insulated. More particularly, it relates to prefabricated rooms or enclosures which can be assembled and disassembled readily without loss of effectiveness.

BACKGROUND

Sound proof or acoustically insulated rooms are used for a variety of purposes, such as privacy of conversations; gathering data on noise sources; or scientific testing. Such rooms or enclosures are found in manufacturing, research and development facilities. For purposes of this description, the abbreviation AE will mean an acoustic enclosure, i.e. an enclosure the interior of which is isolated from acoustic noise but not necessarily other types of interference.

Some enclosures known in the art are constructed of panels joined together by various means. It is desirable to connect adjacent panels and assemble the AE with a minimum amount of hardware, acoustic insulating material, and penetrations of the material (for example by screws or bolts), yet connections should be made in a way which provides a rigid structure. Time and labor for setting up an AE is often expensive because of a large number of complicated parts, structural members and panels, and required assembly sequence.

An example of a known AE is the room described in U.S. Pat. No. 4,794,206 which discloses a room fabricated from panels which have a continuous metallic sheathing filled with acoustic insulating material, such as fiberglass. The panels are fastened together by H-shaped joiners inserted between panels. Bolts and channels on opposite sides of the H-shaped members are used to seal the enclosure. Another example is disclosed in European Patent Publication No. 664659 entitled Perforated Acoustical Attenuators which teaches a porous material comprised of sintered or bonded particles.

DISCLOSURE OF INVENTION

An improved, self-supporting AE has been invented. For enclosures made in reducing the invention to practice, those having a maximum room span of 4.8 meters or less do not require support structure such as I-beams or columns. For larger enclosures, some internal support structure (beams) may be required. However, the enclosures without internal structural support beams could be made larger depending on various design considerations, such as shape of the enclosure, and which way the splines or grooves (described later in this specification) are oriented. The 4.8 meter dimension is not intended to be a limitation on this invention.

The inventive AE can be used for acoustic isolation and comprises a bottom portion having a bottom surface, at least one side wall, and a roof The bottom portion, side walls and roof are constructed of a plurality of adjacent panels under the following conditions:

a. each panel has two major surfaces which face inside and outside of the enclosure respectively, edge portions, and grooves in at least one edge portion, said panels being joined by mating members inserted into the grooves of adjacent panels;

b. each panel is comprised of a material which is an acoustic barrier and has sufficiently high compressive and flexural strength to enable the panels under the greatest stress in the enclosure to withstand such stress without material failure and sufficient Young's modulus to prevent excessive distortion (e.g. as evidenced by binding of a door to the enclosure or sagging of the floor under the load of furniture);

c. there are at least two foil layers, within and approximately congruent with one major surface of said panels, said foil layers being separated from each other by part of the thickness dimension of the panel and arranged so that they at least partially cover the grooves of each panel;

d. there are at least two foil layers at least partially covering the sides of each mating member;

e. the foils of each panel and the mating members inserted into the grooves thereof are in sliding contact with each other; and f. no fasteners which penetrate the panels or mating members are required or present in the enclosure.

The mating members can be, for example, splines to be inserted into the grooves or tongues on adjacent panels to be used in a tongue and groove joint. In either case the dimensions and shapes of the mating members and grooves are correct for press fitting the mating members into the grooves by hand so that the fit is snug, but they can be disassembled by hand as well. The result is a robust construction which is hand built without requiring wrenches, soldering or welding, screwdrivers, touring or any internal or external frame.

The panel material may be a cellular material. One useful syntactic foam comprises a multiplicity of microbubbles having an average outside diameter less than 200 micrometers bound together at their contact points within a matrix, and it has a porosity of 20–60 percent.

The inventive enclosure has the following advantages: light weight; complex shapes can be fabricated; single wall design allowing uncomplicated installation and maximizing interior dimensions; modular; can be tailored to meet acoustic requirements, low or high specifications; and lower cost than known enclosure systems. Because the panel material is substantially lighter than materials currently in use, associated shipping costs to installation sites will be reduced. Reduced weight also facilitates installation and allows use of the enclosure in remote locations where shipping and installing a much heavier and complex unit would be too difficult. The individual panels are smaller than wall panels of currently used prefabricated enclosures. This permits easier physical handling and installation in smaller spaces.

Electrical service and heating, ventilating and air conditioning (HVAC) can be installed through protected openings in the enclosure. The inventive enclosure accordingly provides security and privacy for communications.

DETAILED DESCRIPTION

Figure 1:
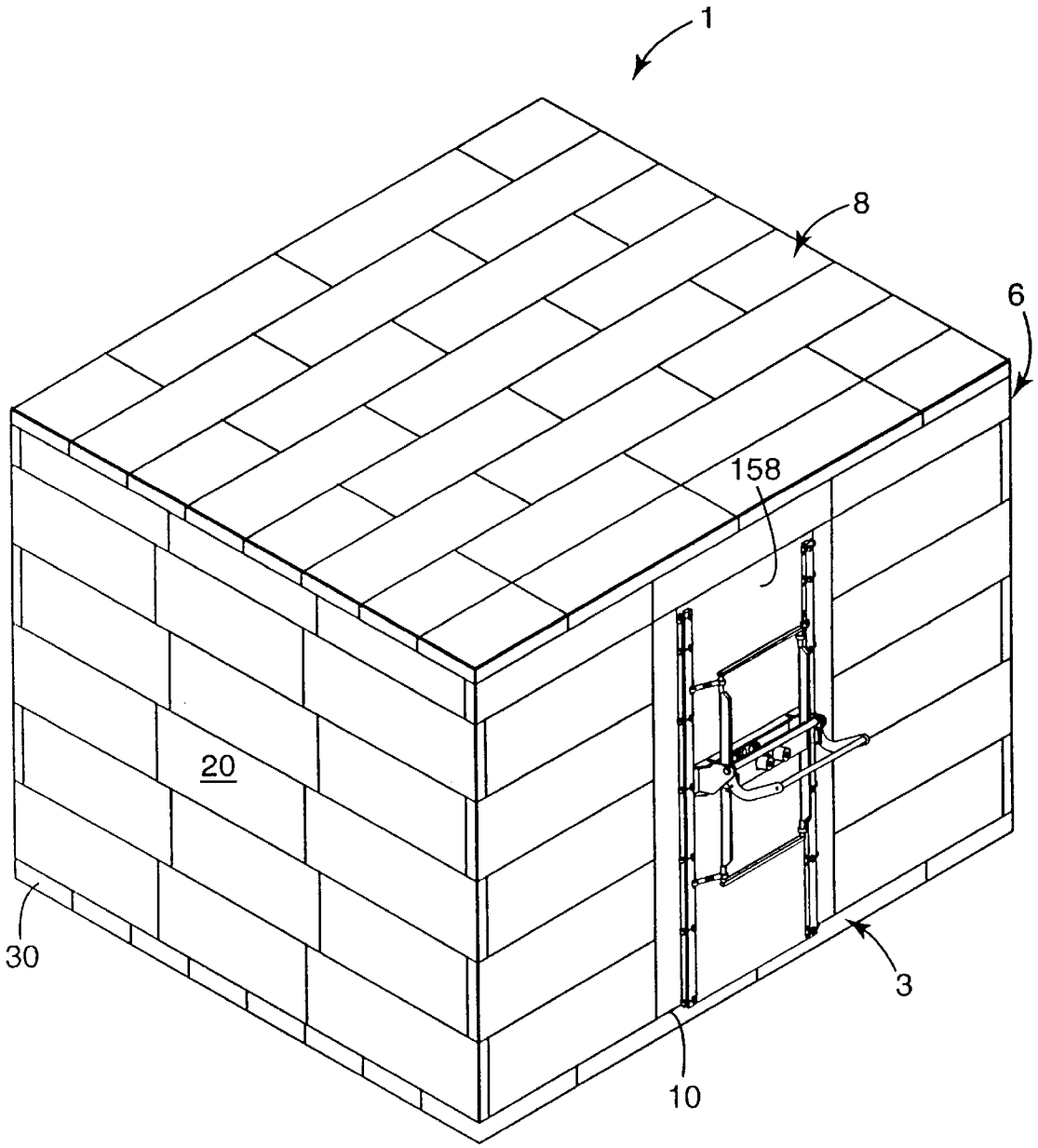
FIG. 1 is a pictorial view of the inventive enclosure (using splines, not tongue and grove joints).

The description which follows will refer to the inventive enclosure as depicted in the drawings which accompany this document. They show a preferred embodiment of the enclosure, and many other variations are within the skill of the art once given this description and the drawings.

FIG. 1 shows enclosure 1 having bottom 3, walls 6 and roof 8. Entry is by means of doorway 10 through door 158. The enclosure may be supported from the bottom by a plurality of pedestals. The walls, bottom and roof comprise a plurality of panels 20. At the corners of the bottom and roof, there are corner panels 30 having grooves oriented somewhat differently from panels 20. Wrapping the outside of the enclosure with cable or strapping can make it physically tighter or more sound structurally.

Placing fiberglass on the inside or outside walls can increase high frequency acoustic attenuation. It also decreases the flammability of the panels.

As an example of the light weight advantage, one embodiment of the inventive enclosure 3.66 m. wide, 3.66 m. deep and 2.74 meters high, excluding the door, HVAC equipment and electrical wiring and fixtures, had the following weight:

| | |
|---|---|
| panels | 1,495 kg. |
| splines | 267 kg. |
| fiberglass | 400 kg. |
| miscellaneous | 263 kg. |
| total | 2,425 kg. |

Figure 2:
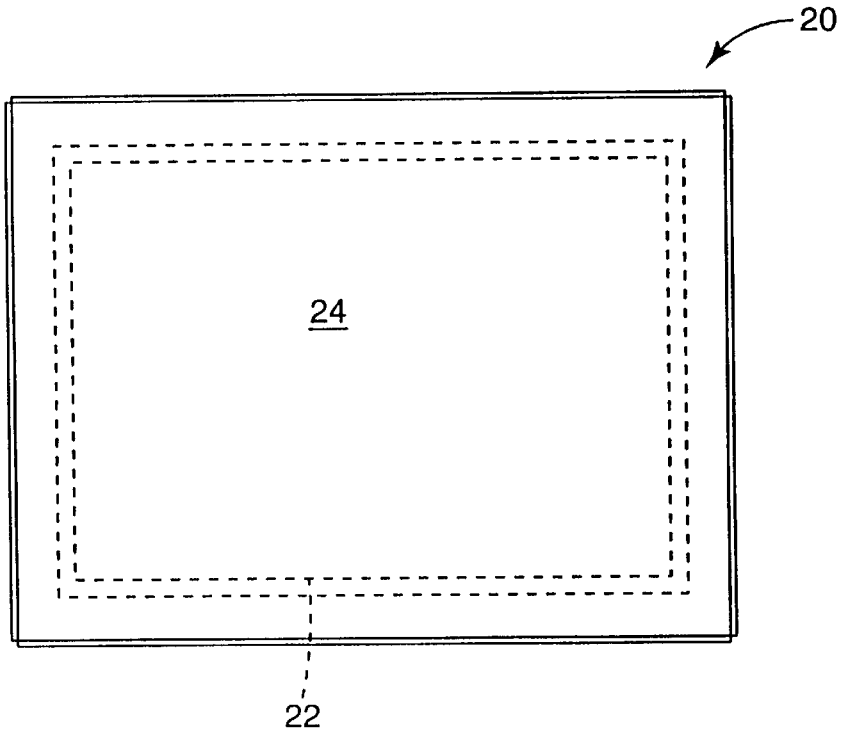
FIG. 2 is a plan or front view of a panel.
Figure 3:
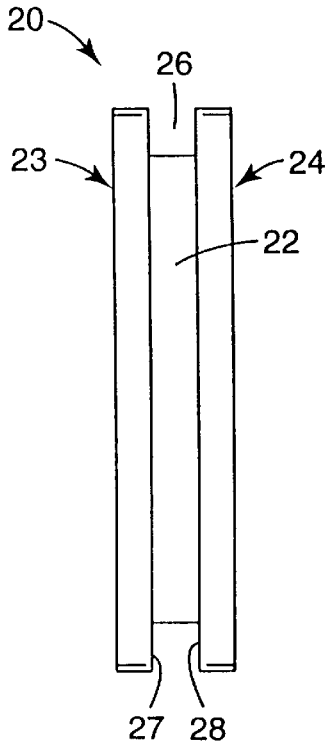
FIG. 3 is a side elevation of a panel.

Panel 20, as shown in FIGS. 2–3, comprises spacer panel 22 separating and bonded to first side wall 23 and second side wall 24 to form groove 26. The three panel components 22, 23 and 24 are bonded to each other by means of a strong adhesive, such as very high bond (VHB) pressure sensitive adhesive from Minnesota Mining and Manufacturing Company of St. Paul, Minn.

Bonded to the inside surface of first side wall 23 (the side facing groove 26) is first foil layer 27. Bonded to the inside surface of second side wall 24 is second foil layer 28. Foil layer 27 can be 5 mils ( 0.127 mm.) thick, and foil layer 28 can be 10 mils (0.254 mm) thick. Preferably they are both no more than 10 mils thick, more preferably, both layers are about 8 mils (0.203 mm) thick. The foils can be made of any sheet material suitable for the purposes of being a wear layer, avoiding seizing, tightness of fit, and sound attenuation. Useful materials include metal foils known in the art (e.g. aluminum, copper or tin coated copper), and polymeric sheeting made of polymers such as polyester or polycarbonate. In both foils 27 and 28, if tin coated copper is used, the thickness of the tin coating is normally in the range of 0.3–0.6 mils (8–15 $\mu$m), preferably about 0.5 mils (13 $\mu$m). Tin coated copper foil is available from A. J. Oster, Inc. of Cleveland, Ohio.

The material of construction for the panels is preferably a sound barrier; however it must be structurally sound, preferably having a density which is substantially lower than previously used materials for AE. Some feasible materials are: fiber reinforced plastic; syntactic cellular materials (i.e. composites containing microbubbles); cellular plastics (e.g.,) polstyrene plastic available under the trademaker "Styrofoam".

The strength of the panels must be sufficient to bear the load of the enclosure itself and its contents, and it depends somewhat on the span and weight of the roof. A conservative figure for tensile strength is a minimum of 50 psi. ( 0.24 Mpa (megaPascals)), preferably greater than 100 psi. ( 0.69 MPa). The acoustic composite material (ACM) used in preferred embodiments of the invention is characterized by a tensile strength of 300–450 psi (2.07–3.1 MPa) and a density of 14 lbs/ft.$^3$ (225 kg/m$^3$). Compressive strength should be at least 10–20 psi. (0.069 Mpa- 0.14 MPa). Specific stiffness is typically 1 to $8\times10^6$ psi/(lb/in$^3$) (0.25–1.99 MPa/(kg/m$^3$). Young's modulus or flexural modulus, as measured by a three point bend test similar to ASTM D790–86, is typically greater than 200 psi (1.38 MPa), preferably greater than 500 psi (3.45 MPa), more preferably greater than 2,500 psi (17.2 Mpa), even more preferably greater than 10,000 psi (69.0 Mpa). Sample size used for this test was 5 in. (127 mm) span, 0.5 in. (12.7 mm) width, and 0.38 in. (9.7 mm) depth. Tensile modulus is preferably above 2,000 psi (13.8 Mpa).

The ACM has good low frequency acoustic performance because of its stiffness. Good low frequency performance means that it operates above mass law performance in attenuating 100–500 Hz sound.

One syntactic cellular composite material of construction for the panels comprises ceramic filler particles, which can be hollow spheroids, in a carbonaceous matrix, preferably a starved matrix, having a surface available for coating. The term starved matrix means that there is less matrix material present than the amount which would completely fill the voids between the filler particles. A starved matrix results in a porous microstructure in which the ceramic filler particles are interconnected by the matrix, typically an organic polymer or resin binder, with pores or voids present between the ceramic. filler particles or hollow spheroids (i.e. the binder forms necks between the filler particles or microbubbles leaving substantial voids between them). Cellular materials may be open-celled like ACM with interconnected pores in the matrix, or closed-cell without cell interconnection.

The syntactic cellular composite material may be coated with a metal, compound, ceramic, or other coating. Two useful coating materials are silicon carbide and silicon nitride.

ACM is made by the following steps:

(a) providing a mixture comprising a multiplicity of microscopic, hollow, ceramic, filler particles and a curable organic polymer binder which upon curing binder yields an article having a starved matrix microstructure; and (b) curing the binder polymer.

Examples of suitable filler particles are: hollow aluminosilicate bubbles having a particle size of about 10 to 350 micrometers, commercially available from PQ Corporation, Valley Forge, Pennsylvania under the trademark Extendospheres; Z-Light bubbles commercially available from Zeelan Industries, St. Paul, Minnesota under the product designations W1012 Z-Light, W1200 Z-Light, W1600 Z-Light, W1000 Z-Light, G3400 Z-Light, and G3500 Z-Light; oxide and non-oxide ceramic bubbles such as those prepared by the methods described in Moh, U.S. Pat. No. 5,077,241 having particle sizes of about 1 to 300 micrometers; ceramic spheres having closed cell porosity as described in U.S. Pat. Nos. 4,869,960; 4,680,230; and 4,632,876 and sold by Minnesota Mining and Manufacturing Company under the trademark Macrolite (preferably in the particle size range 200–400 micrometers). Solid aluminosilicate spheroids, sold for example under the designation Zeeospheres by Zeelan Industries may also be used in mixture with the hollow spheroids, depending on the final density desired.

Preferred filler particles are microbubbles made from ceramic (including glass) or polymeric material. Most preferred are glass microbubbles available from Minnesota Mining and Manufacturing Company as Scotchlite microbubbles, type K15 or C15/250, having a density of about 0.15 grams/cc and a hydrostatic compressive strength of at least 250 psi (1.72 MPa). Average outside diameter or particle size is 5–150 micrometers, more preferably about 70 micrometers. Wall thickness of the microbubbles is typically an order of magnitude smaller than the outside diameter or particle size, a typical range being 1–2 micrometers.

The binder (which may be a liquid or solid powder at room temperature before curing) can be an epoxy resin, phenolic resin, polyethylenes, polypropylenes, polymethylmethacrylates, polyurethanes, cellulose acetate polymers, or polytetrafluoroethylene. It may include elastomers such as polychloroprene, ethylene propylene diene (EPDM), and other rubbery polymers, and also silicone compounds such as RTV-11 and RTV-615 from General Electric Company. The method can further comprise applying a second organic binder to the article prior to step (b). A preferred binder is a powdered epoxy resin compound available as Scotchcast 265 from Minnesota Mining and Manufacturing Company. Suitable phenolic resins include acid and base catalyzed phenolic resins. Examples of commercially available phenolic resins are: Durez resin from Occidental Chemical Corp., Dallas, Tex., Dufite-SC-1008 from Borden Chemical Co., Columbus, Ohio, and BKUA-23 70-UCAR (a water based phenolic resin) from Union Carbide Corporation, Danbury, Conn.

The void diameter between hollow filler particles in the starved matrix is measurable by known mercury intrusion techniques, and can be in the range of 25–50 micrometers. It is preferred that the void diameter in the starved matrix or porous material approximate the viscous skin depth of the ambient medium (which depends on the viscosity and density of the medium and the incident frequency of the sound). For example, the viscous skin depth of air varies from 200 micrometers at 0.1 kHz to 70 micrometers at 1 kHz to 20 micrometers at 10 kHz.

Alternatively, the ACM may be characterized by a porosity of 20–60 percent. In determining porosity, the hollow spheroids are assumed to be solid particles. Air flow resistivity of the ACM can be in the range of $0.5\times10^4$ to $4\times10^7$ mks rayls/meter, and the sound attenuation by the ACM is comparable to mass law performance. An attenuation of sound is considered comparable to mass law performance when it is not less than 10 dBA below the theoretical performance predicted by either the field incident or normal incident mass law, over substantially all of a frequency range of 0.1 to 10 kHz, other than coincidence frequencies.

The ACM is prepared by mixing a mass of the hollow ceramic spheroids or microbubbles with resin binder and other optional additives in a solids blending apparatus, such as a twin shell blender. The mass ratio of binder resin to microbubbles can be in the range of 1:1 to 3:1, preferably about 1.5:1. After thoroughly mixing the ingredients, the mixture is poured into a mold having the desired shape, for example the shape of first side wall 23. The mold preferably has dimensions slightly larger than those of the finished article. The mold is previously treated with a release agent such as a fluorocarbon, silicone, talc or boron nitride powder. The mold is placed into an oven, and the mixture is heated in the mold at a temperature sufficient to cause the binder to melt, flow around the spheroids and cure. In the case of the epoxy and phenolic resins, a typical temperature is about 170° C. For large articles, it is desirable to increase mold temperature gradually (e.g. over 3.5 hours) to the final cure temperature to prevent thermal stresses from developing. The mold is then maintained at curing temperature, e.g. for 1.5 hours and is allowed to cool down to room temperature. ACM made within these parameters would not support a flame in horizontal flame tests.

After the mold and cure cycle is complete, the molded article is removed from the mold. The cured ACM typically has a density of about 0.2 g/cc. An additional resin can optionally be applied to the article by, for example, dipping it in a bath of the resin or brushing it onto the article. For example, a coating of phenolic resin may be applied to the article which is heated again. The article may be shaped by machining methods known in the art, such as milling, planing and sanding. The ACM parts are preferably overcoated with two-part epoxy resin to reduce friability. This coating also helps in adhering the foils, described hereinafter, to the various parts made of ACM.

In making a typical panel 20, three ACM parts made as described above, are provided, spacer panel 22, first side wall 23 and second side wall 24. Foil layers 27 and 28 with VHB adhesive on one side are laminated to side walls 23 and 24 respectively. Although foils 27 and 28 are about the same shape and size as a panel major surface, they are slightly larger. They are large enough and are arranged in such a way that they overlap the edges of panel 20. Thus, the first and second side walls are preferably covered by foil on five sides. In the same way, spacer panel 22 is bonded to the two side walls each having laminated foil layers on the inside surface. The foils achieve durability.

One example of a finished panel comprises the following parts bonded together with Scotch brand VHB tape:

1. two 18 inch (457 mm)×24 inch (610 mm)×1⅛ inch (29 mm) side walls 23 and 24;
2. one 14 inch (365 mm)×20 inch (508 mm)×1¾ inch (44 mm) spacer panel;
3. the foils 27 and 28 as depicted in FIGS. 2–3;

This gives a groove about 2 inches (51 mm) deep all around the panel.

Figure 7A:
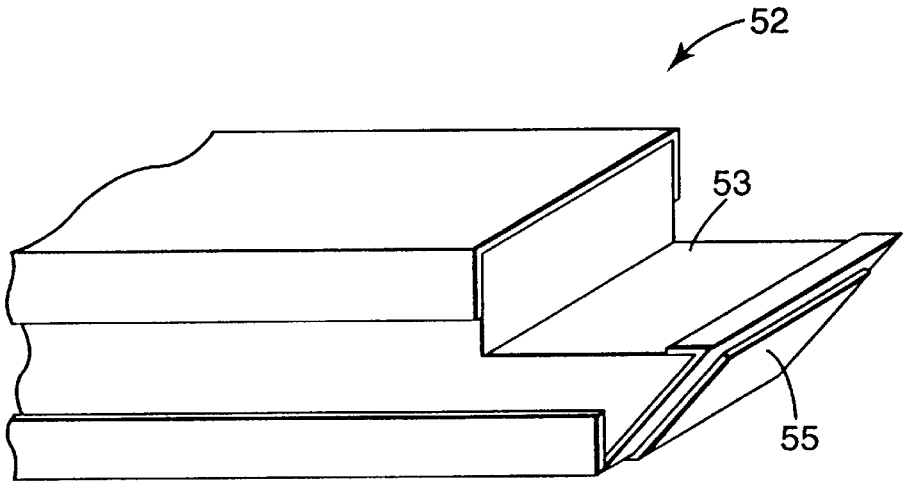
FIG. 7*a* is pictorial view of a corner spline intended for joining vertical corner panels as shown in FIG. 3*a*.
Figure 7:
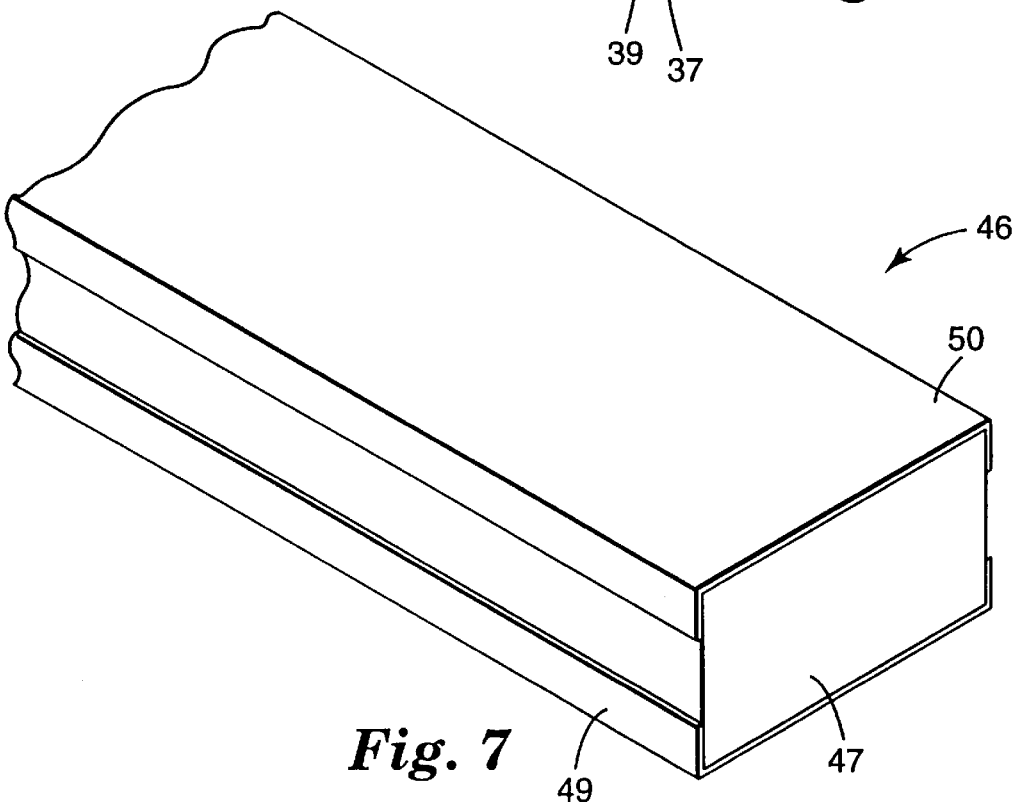
FIG. 7 is a pictorial view of a spline.

Although tongue and groove joints may be used, the remainder of this description will use splines (item 46 in FIG. 7 and item 52 in FIG. 7*a*) as the mating members for purposes of discussion. The splines can be constructed of the same material and generally in the same way as the panels. Spline core 47, made for example of ACM, is laminated with first and second metal foils 49 and 50, all such laminations being accomplished with adhesive, such as VHB adhesive. The foils on the splines are placed where the spline contacts the panel grooves. In the finished enclosure, the foil layers on the splines should physically contact the foils on the panels located closest to the interior of the enclosure. A typical spline for the panel described above would be 4 inches (102 mm) wide ×1/3;4inches (44 mm) thick, with various lengths.

Figure 4:
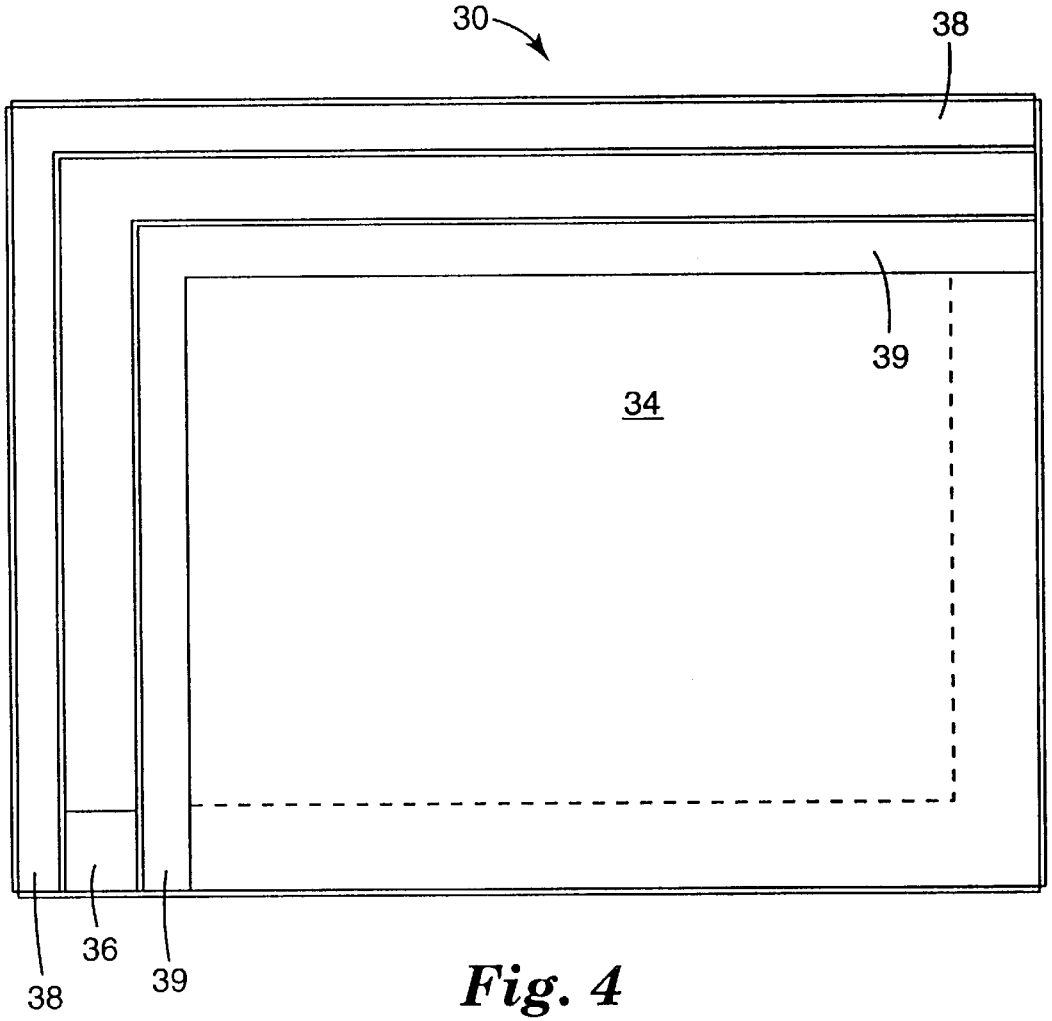
FIG. 4 is a plan or top view of a bottom corner panel.
Figure 5:
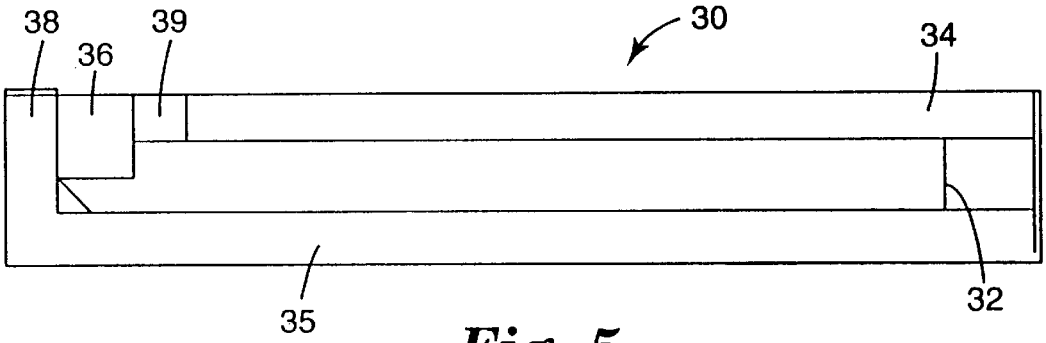
FIG. 5 is a front elevation view of the bottom corner panel of FIG. 4.
Figure 6:
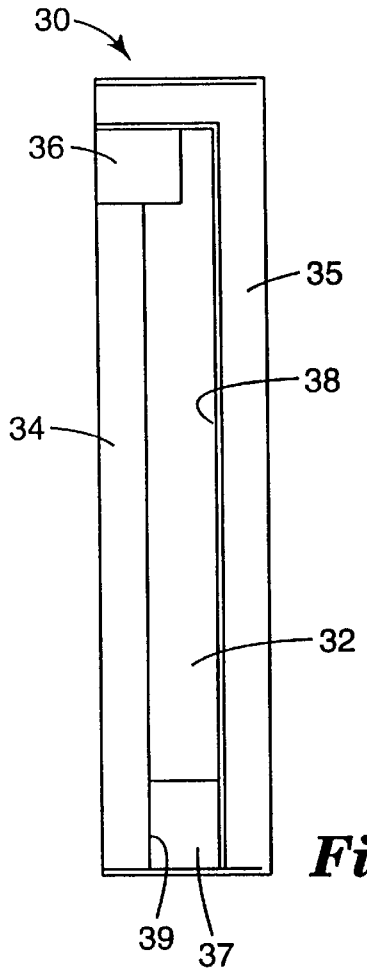
FIG. 6 is a side elevation view of the bottom corner panel of FIG. 4.

FIGS. 4–6 depict bottom corner panel 30 which is made in a similar manner to wall panel 20 described above. It comprises: spacer panel 32, top wall 34, bottom wall 35, first and second foil layers 38 and 39. However, panel 30 has a special shape. On the bottom edges which face away from the enclosure exterior there is edge groove 37. The bottom wall 35 is L-shaped, and the spacer panel 32 and top wall 34 are shaped and oriented so that there is a channel groove 36, which, when panel 30 is installed, faces upward.

Channel groove 36 is L-shaped in the plan view FIG. 4 (looking from top down). Panels located along the edges of the bottom 3 of enclosure 1 in between the comers (e.g. floor edge panel 61 shown in FIG. 9) also have channel grooves, but those channel grooves are straight, not L-shaped as they are on the corner panels.

Figure 12:
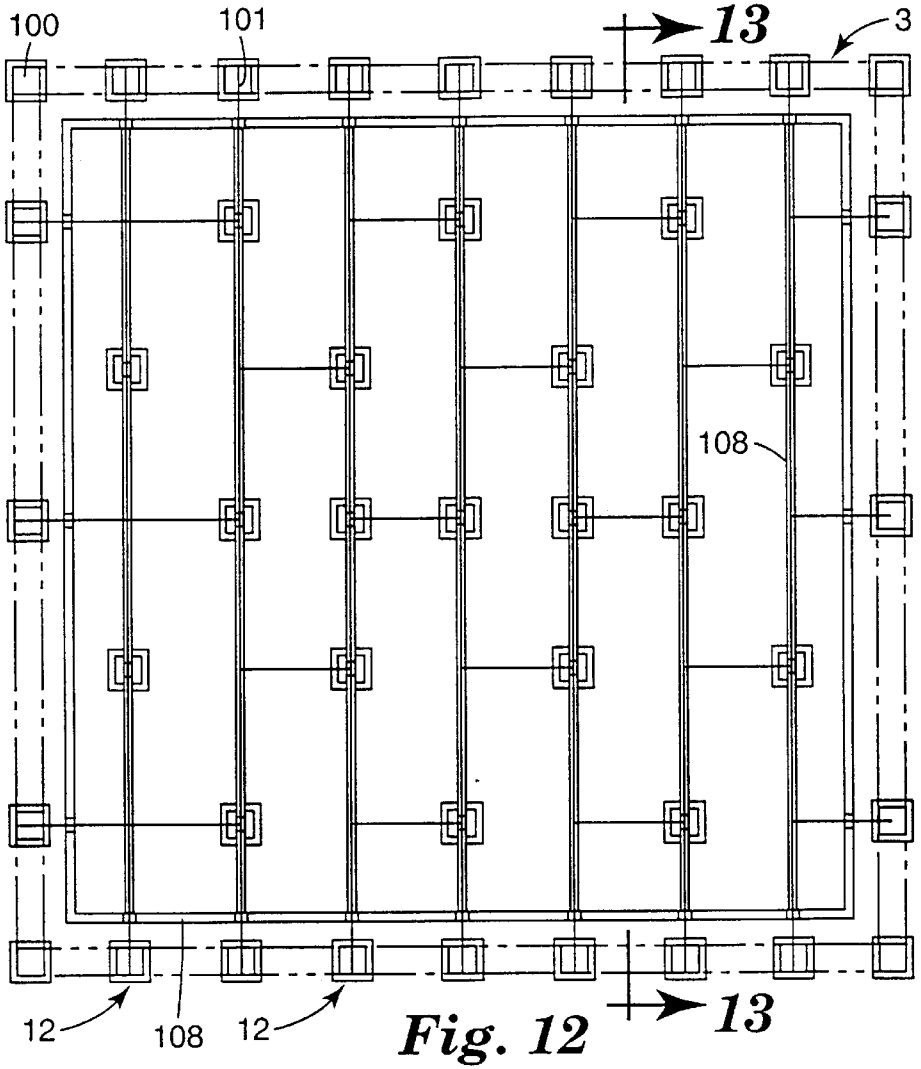
FIG. 12 is a plan or top view of the bottom of the enclosure.

The enclosure can be supported from below by any support means known to those skilled in the art, preferably means which elevates the AE above the substrate floor. One such means of support comprises pedestals. Construction of the enclosure preferably begins by placing the pedestals 12 in correct position, as shown by FIG. 12. A preferred pedestal comprises a base and vibration dampener. The base can be made of any suitably strong material. In constructing an embodiment during the reduction to practice of the invention, the base was made of ACM coated with a hard coating for protection. The vibration dampener can be any vibration dampening material known in the art appropriate to the degree of damping desired, such as rubber pads.

Before beginning to place the pedestals, the floor of the host room should be checked to be sure that it is level. As shown in FIG. 12, the pedestals are located to provide good support and isolation from the floor of the room in which the enclosure is placed. Thus, pedestals are placed at outside corner 100, at the ends of joints between bottom panels (joint end 101), and at joint intersections. The pedestals are fixed to the floor of the host room using an adhesive such as silicone adhesive.

Figure 8:
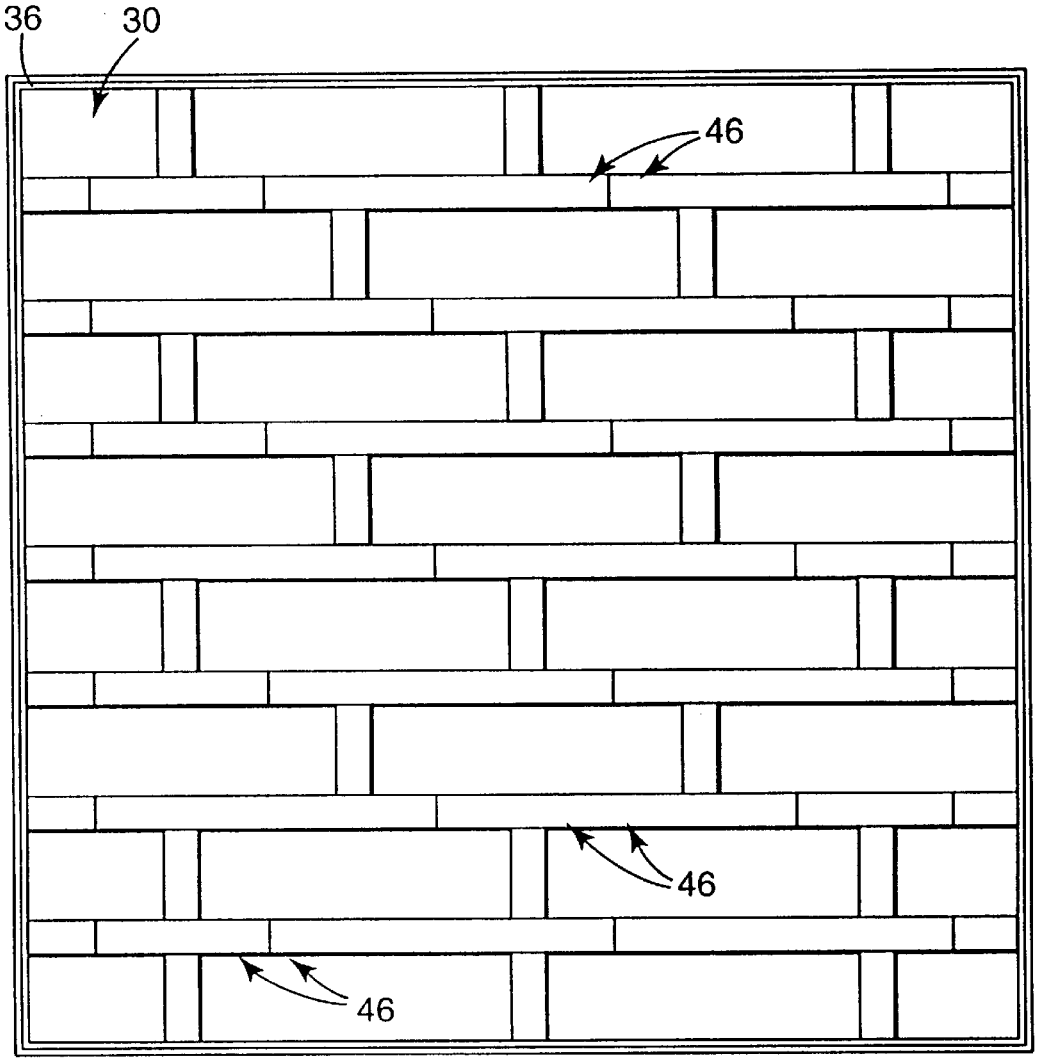
FIG. 8 is a schematic top view of the bottom of the enclosure showing the panel and spline arrangement. In actuality the splines would be overlapped by the floor panels and hidden from view.

Then, the bottom 3 is constructed of panels and splines in a pattern as shown in FIG. 8. The splines 46 for the bottom are placed in staggered positions so that block and spline seams are not aligned. The dimensions of the grooves and splines are made so that the splines are press-fit or friction fit into the grooves very tightly or snugly, but by hand.

The bottom panels are installed carefully so that the corners of the enclosure bottom are nearly exactly 90°, and the edges are straight. The rows of floor panels are squared by clamping and measuring the diagonals across the rows. They should be nearly the same length (e.g. within 2 mm of each other). When the bottom is constructed, a nylon strap can be installed around its perimeter with L-shaped corner protectors at each corner.

Figure 13:
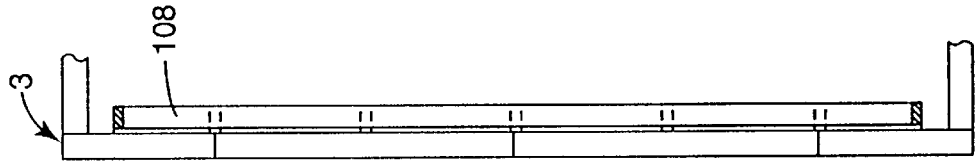
FIG. 13 is a section view of the bottom of the enclosure.
Figure 15:
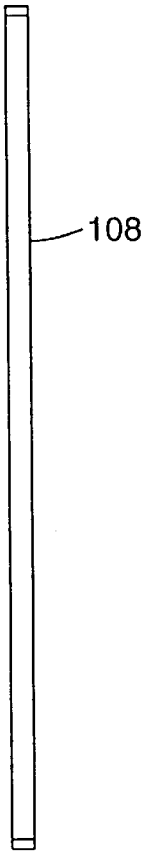
FIG. 15 is a side elevation of the floor.
Figure 14:
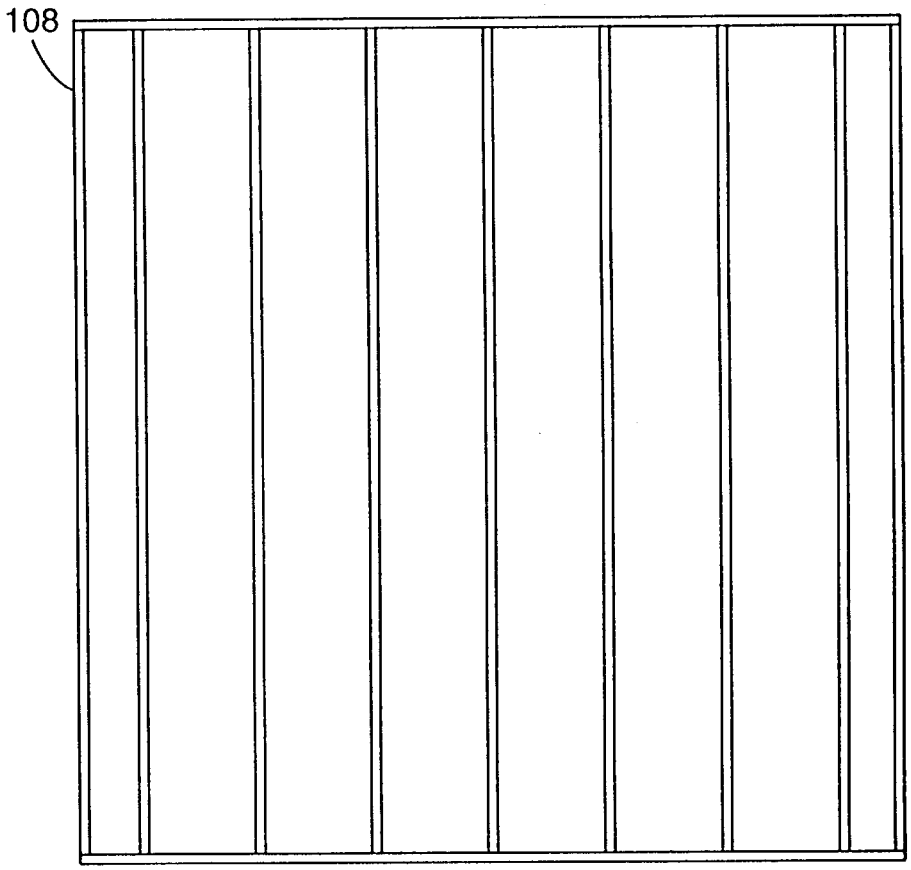
FIG. 14 is a plan view of the floor which is inside the enclosure.

The bottom is next covered with a layer of insulation such as fiberglass (typically 2.5 cm thick). The internal floor frame 108, shown in FIGS. 13–15, is installed on top of the fiberglass. Vibration damping pads are placed in between the floor frame 108 and the fiberglass in registry with the pedestals. The spaces in between the floor joists are filled with insulation such as fiberglass. Internal frame 108 with fiberglass in between the joists is covered by two plywood sheets which are fastened (e.g. by screws) to the internal frame.

The location is found for the long vertical door splines 152, and they are installed. These splines are different from the splines as previously described. For added strength, they are aluminum channels of the same general shape shown in FIG. 7, having an interior filled with ACM. This type of spline is called a super spline and is also used to join panels in other places where extra strength is desired, such as the roof The super splines have foil wraps like foils 49–50 shown in FIG. 7. The door splines are temporarily held in place during construction of the walls by supports (e.g. wooden boards).

Figure 9:
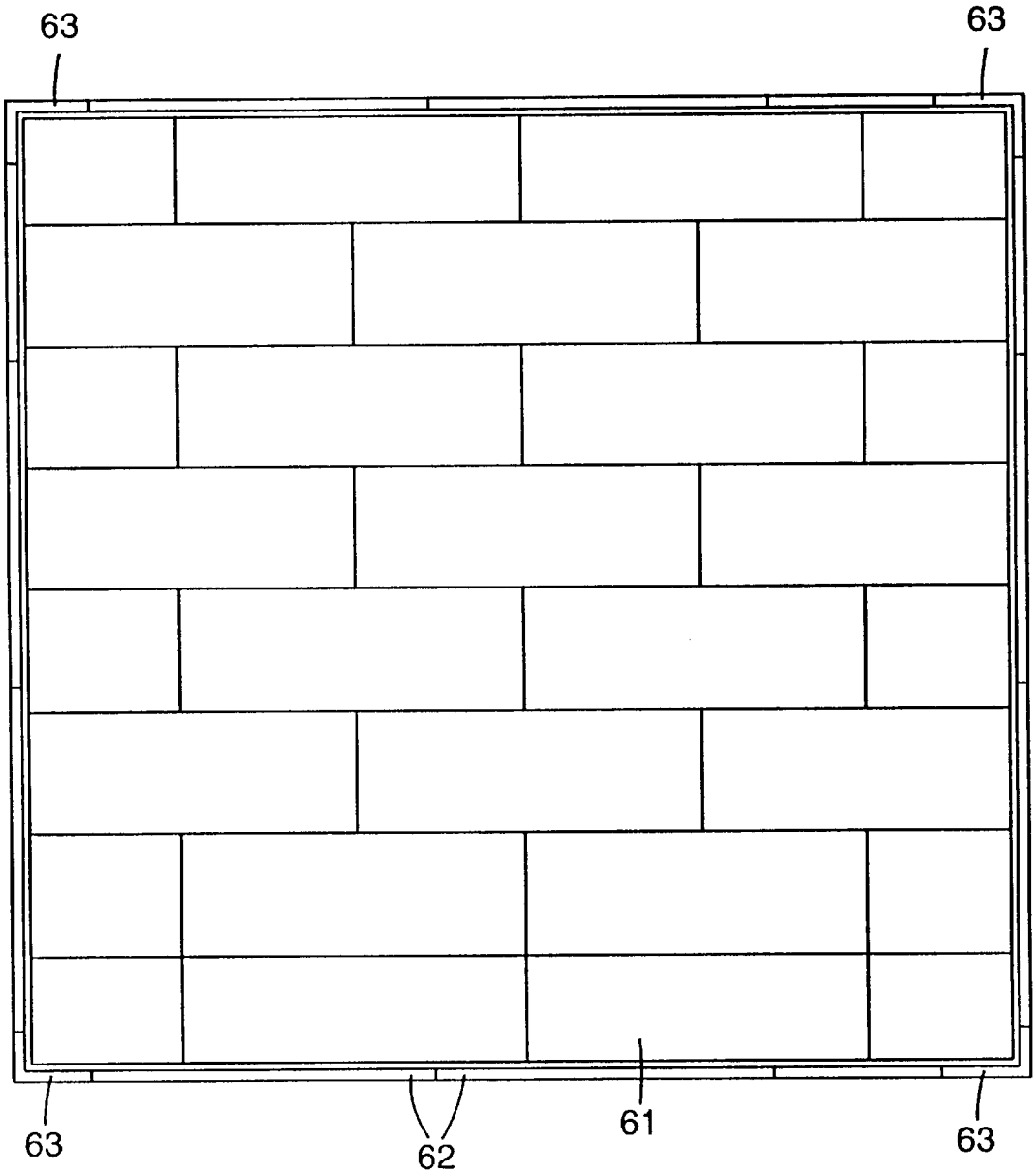
FIG. 9 is a plan or top view of the first course of wall splines showing how they are arranged in the upward facing grooves of the bottom panels.

The wall splines are pressed into the channel grooves of the outer floor panels, as shown in FIG. 9. There are straight splines 62 and L-shaped splines 63 for the corners.

Figure 3A:
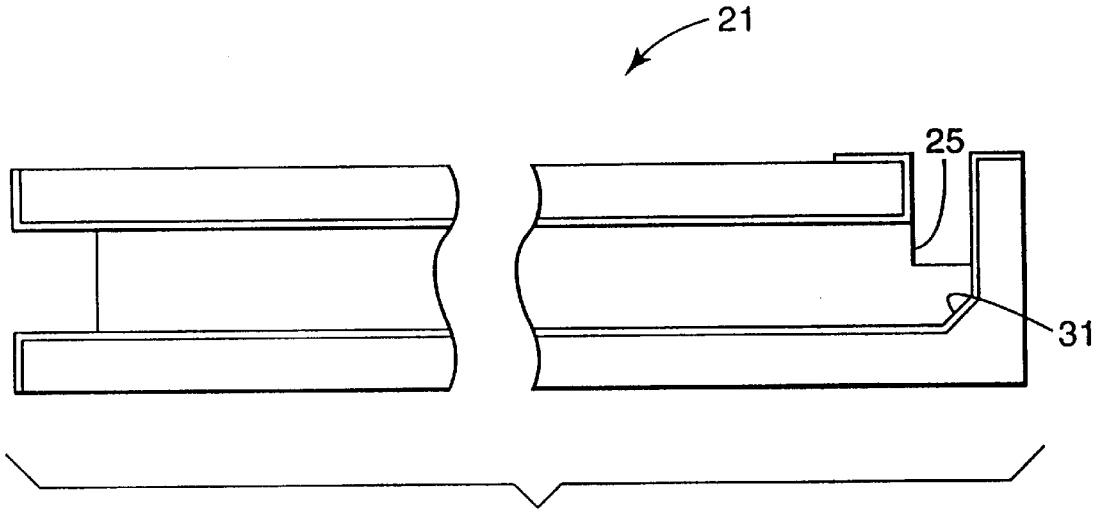
FIG. 3*a* is a top view of a vertical corner panel.
Figure 10:
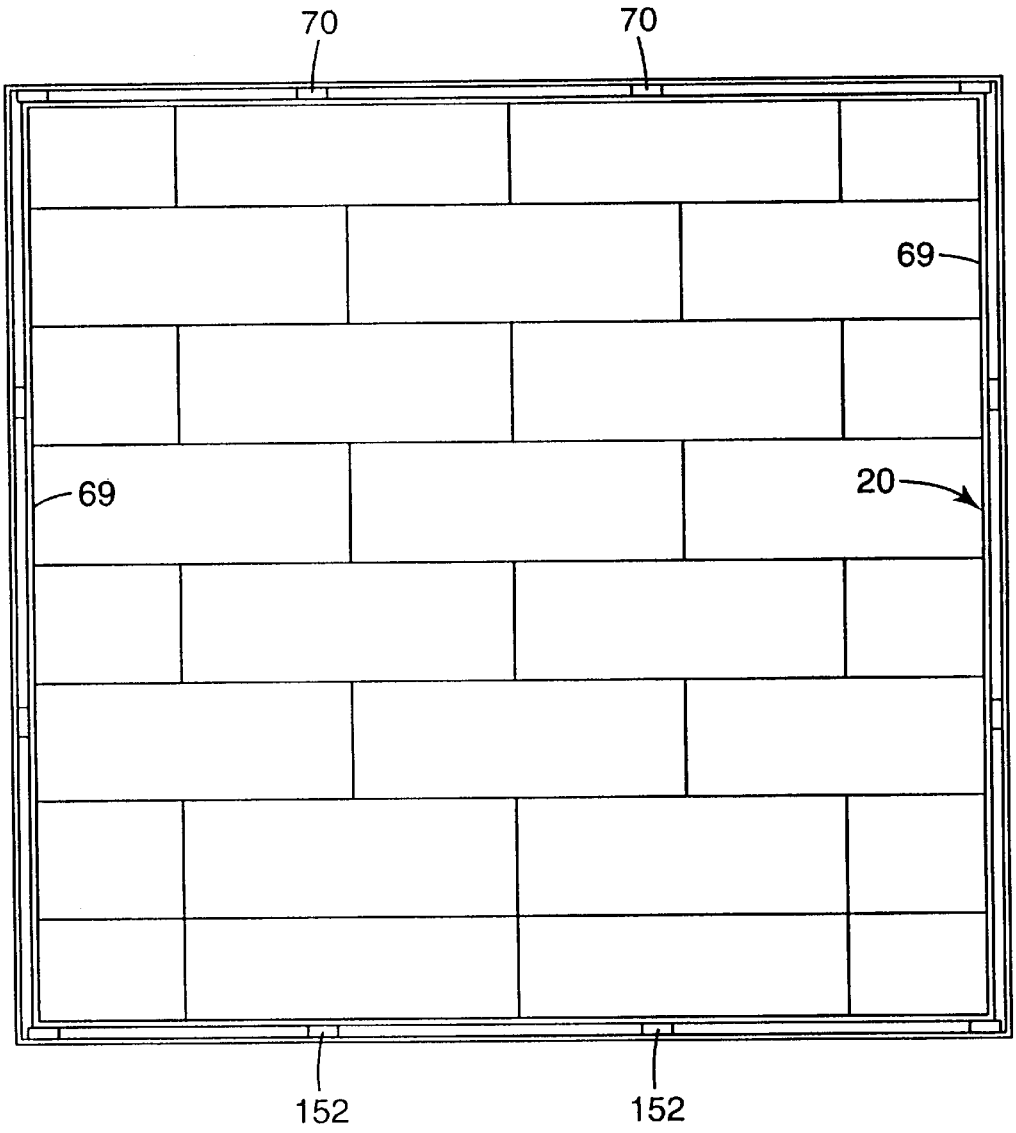
FIG. 10 is a plan or top view of the first course of wall panels showing their upward facing grooves and the first course of vertical splines which join the side or lateral facing grooves of the wall panels.

The first course of wall panels 69 is installed by press fitting panels onto the first course of wall splines as shown by FIG. 10. Vertical splines 70 are press fit into the vertical grooves of adjacent wall panels. At the corners, vertical corner panels 21 (shown in FIG. 3*a*) having specially shaped spacer panels are used. The spacer panel has notch 25 and bevel 31. The splines 52 for these vertical corner panels (shown in FIG. 7*a*) have corresponding notch 53 and bevel 55. The wall is built by adding successive courses of wall panels and splines until the desired height is reached.

Figure 11:
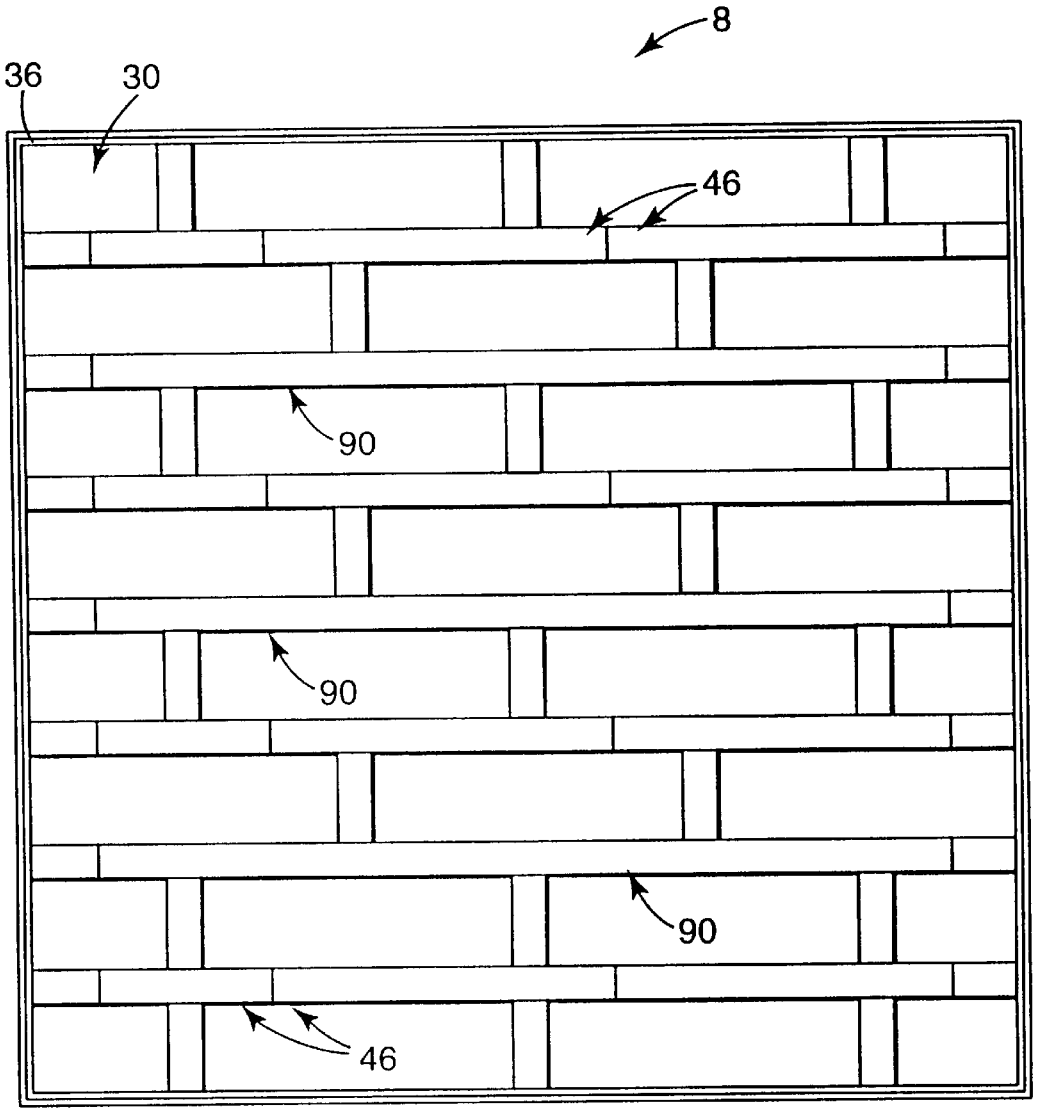
FIG. 11 is a schematic top view of the roof showing how the roof panels and splines fit together. In reality, the roof splines would be overlapped by the roof panels and hidden from view.

The roof is assembled in a manner similar to the floor, using edge and corner panels having channel grooves oriented in a way that allows them to be press fit onto the last course of wall splines. In FIG. 11, the super splines 90 used to join certain roof panels are shown. Roof panels can be temporarily supported during construction by a T-bar and hydraulic jack or other support means known in the construction art. In one construction technique, the long dimension of the roof panels are oriented at 90 degrees to the long dimension of the bottom panels.

Figure 16:
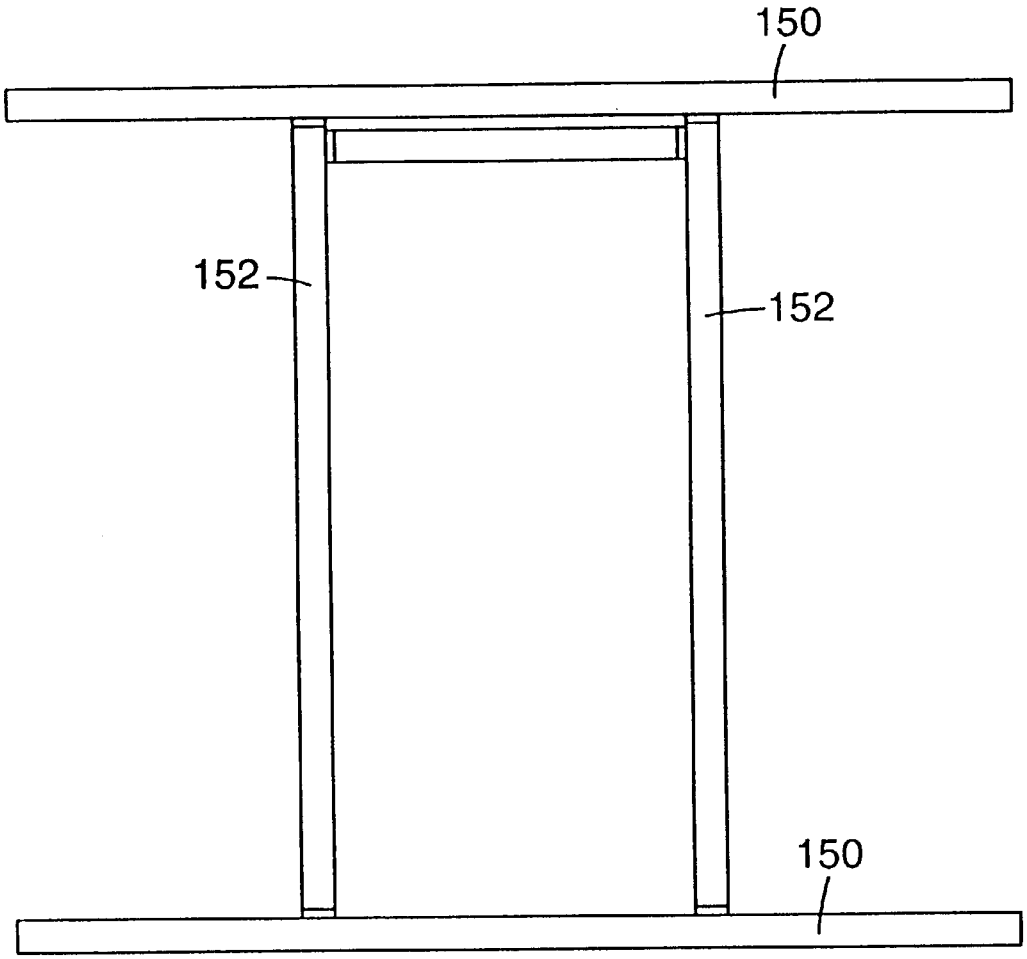
FIG. 16 is a front elevation view of the large splines around the door opening.

The horizontal and vertical super splines, 150 and 152 respectively, which support the door frame are shown in FIG. 16. They are located in the grooves of the panels close to doorway 10. They are also wrapped by foils, as shown in Figure 21. Foil 154 is wrapped around the part facing inside the enclosure. Foil 153 contacts foil 155 as shown which makes contact with the vertical wall panels not shown in FIG. 20.

Figure 18:
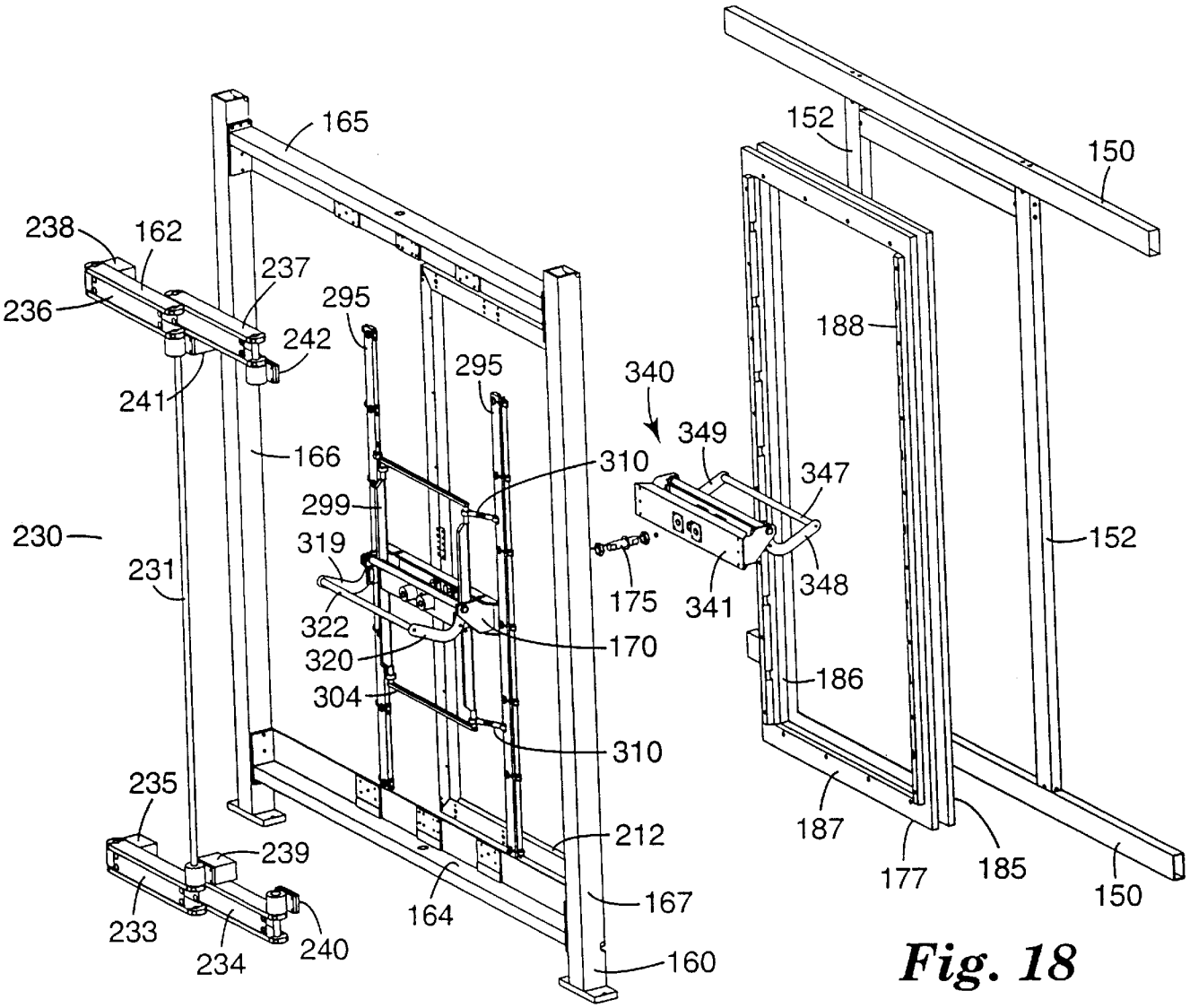
FIG. 18 is an exploded view showing certain door components.
Figure 19:
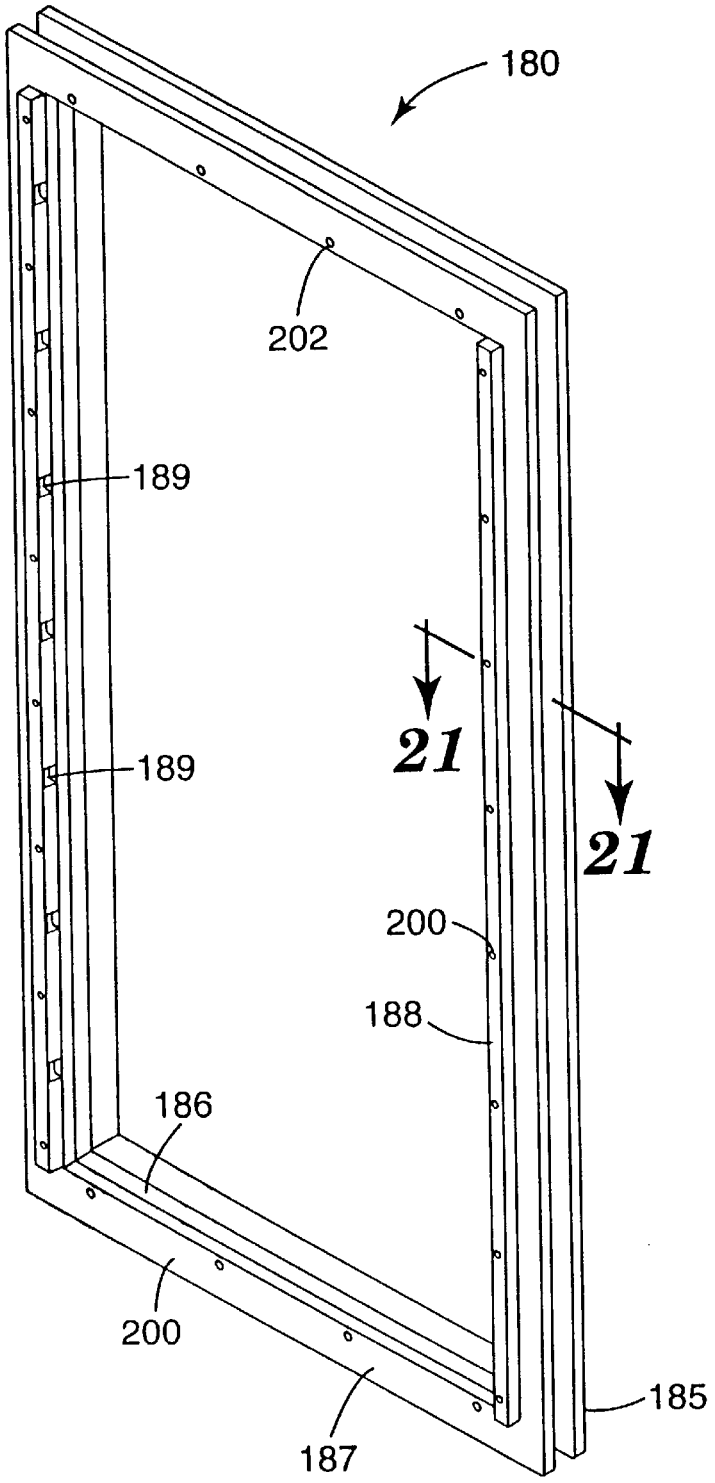
FIG. 19 is a pictorial view of the internal door frame.
Figure 20:
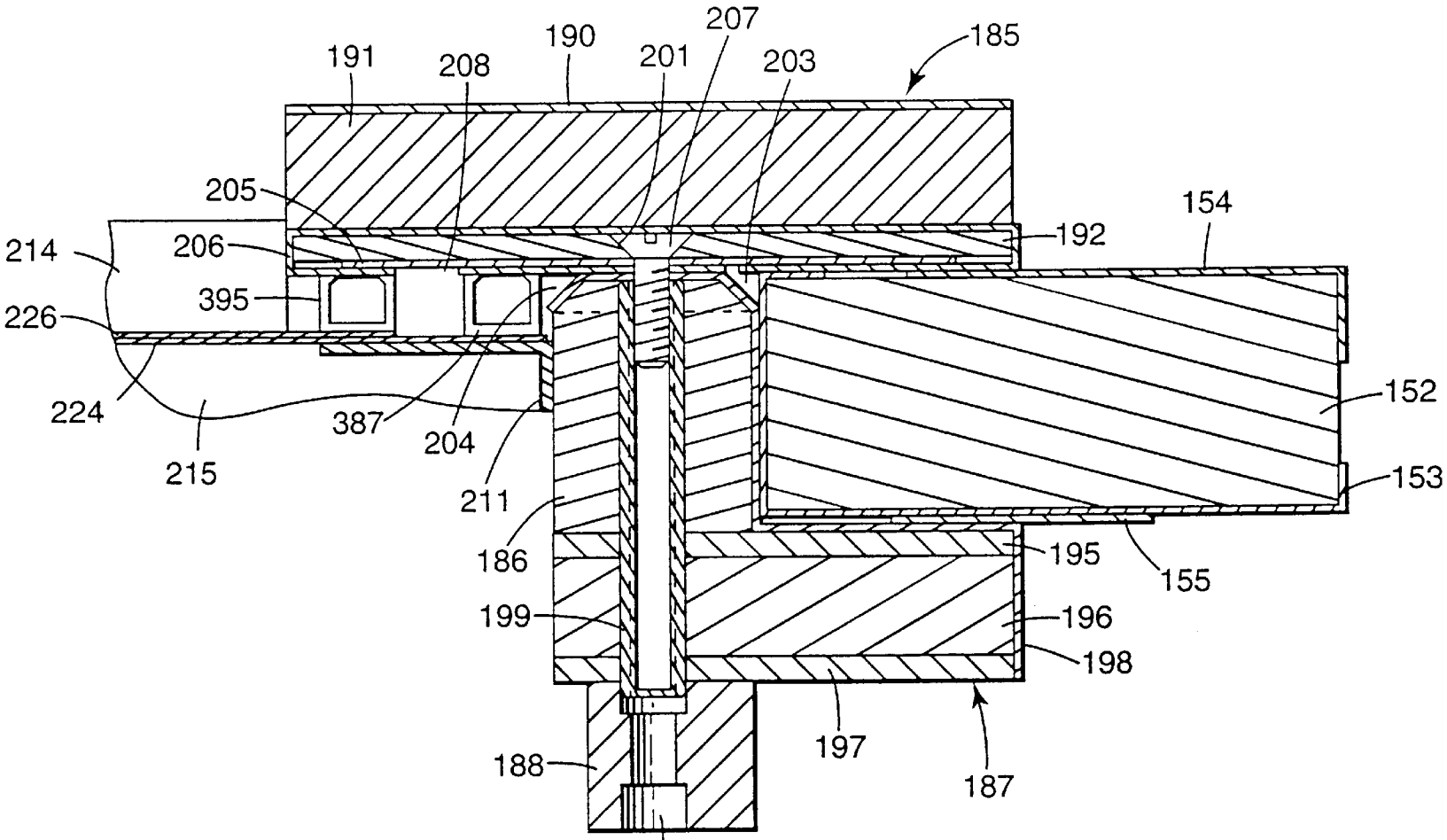
FIG. 20 is a section detail of the internal door frame also showing a partial view of the door in the closed position against the frame.
Figure 21:
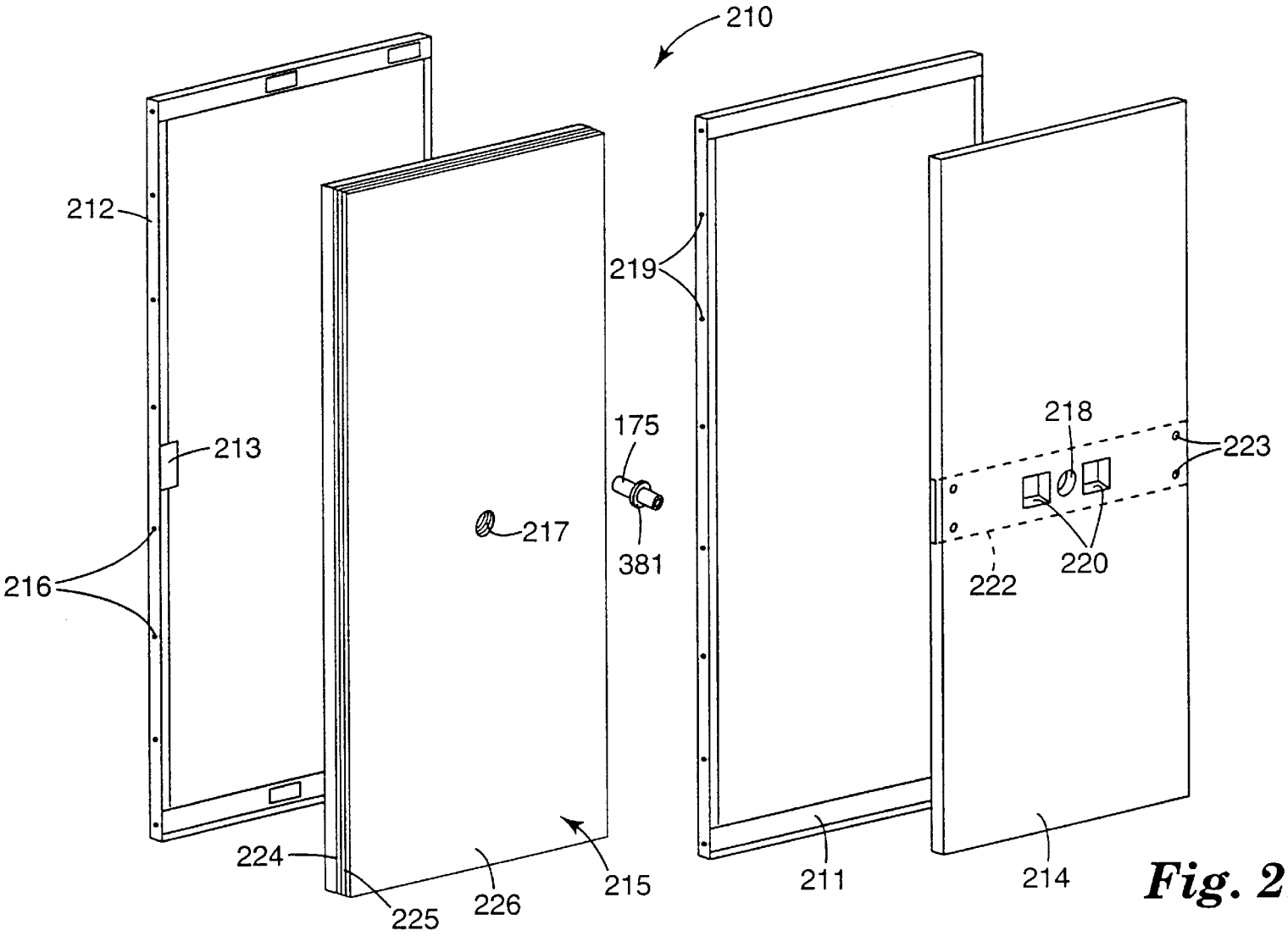
FIG. 21 is an exploded view of the door leaf assembly.
Figure 22:
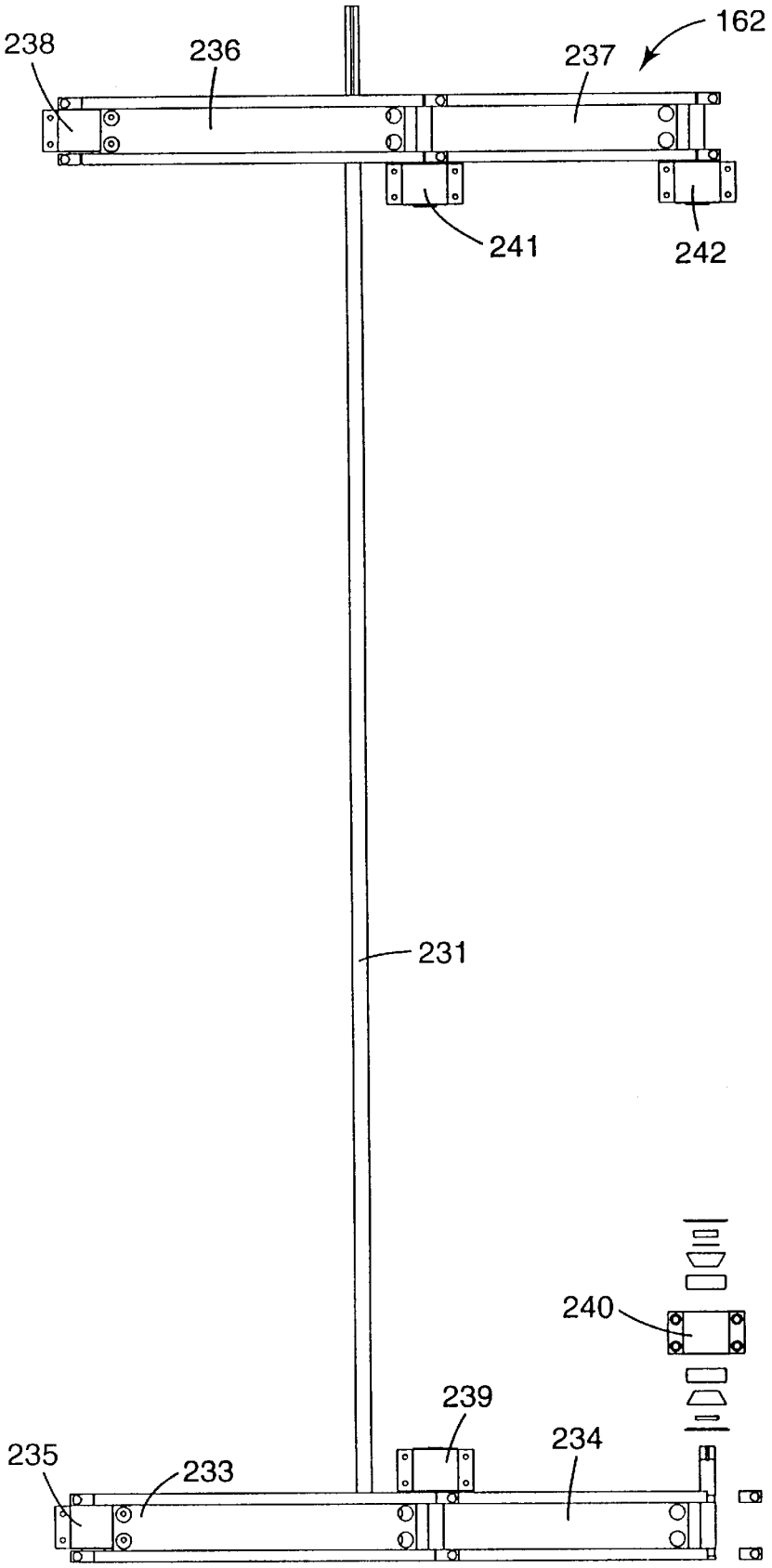
FIG. 22 is a front elevation view of the door hinge assembly.

The door frame 180 shown in FIGS. 18–20 is installed around and fastened to the super splines around the doorway. It comprises inside frame 185, spacer 186, outside frame 187, and clamping wedge 188. The inside frame 185 and outside frame 187 can be aligned by mechanical means known in the art such as alignment pins. The inside frame comprises interior finish plate 190, ACM core 191, and seal plate 192. Around seal plate 192 is placed foil layer 206, capturing bolt 207 which is placed in hole 201. Before the foil wrapping is finished, bolt 207 is threaded into threaded sleeve 199 and tightened.

The inside frame, spacer, and outside frame can be made of any material of construction suitable to the task. In the work of reducing the invention to practice, aluminum was used. Part of spacer 186 and outside frame 187 are covered by foil 198. The portion of the spacer 186 nearest the inside frame is chamfered, and the spaces 203 and 204 in the assembled door frame are preferably occupied by acoustic seals. Outside frame 187 comprises inside plate 195, filler plate 196, and outside plate 197. The clamping wedge 188, outside frame 187 and spacer 186 are penetrated by bolt hole 200 which is lined with sleeve 199. The door frame is fastened together by bolts inserted through holes 200 and tightened by means of the threads in threaded sleeve 199. In parts of the door frame where there is no clamping wedge (top and bottom) the inside frame, outside frame and spacer are fastened together in a similar manner by screws through holes 202.

The clamping wedge has a plurality of indentations 189 which are engaged by cam rollers 316 on the exterior latch assembly. The indentations 189 have surfaces shaped to draw the cam rollers into the indentations and also somewhat laterally as they are moved inward toward the interior of the enclosure by exterior latch assembly.

Figure 17:
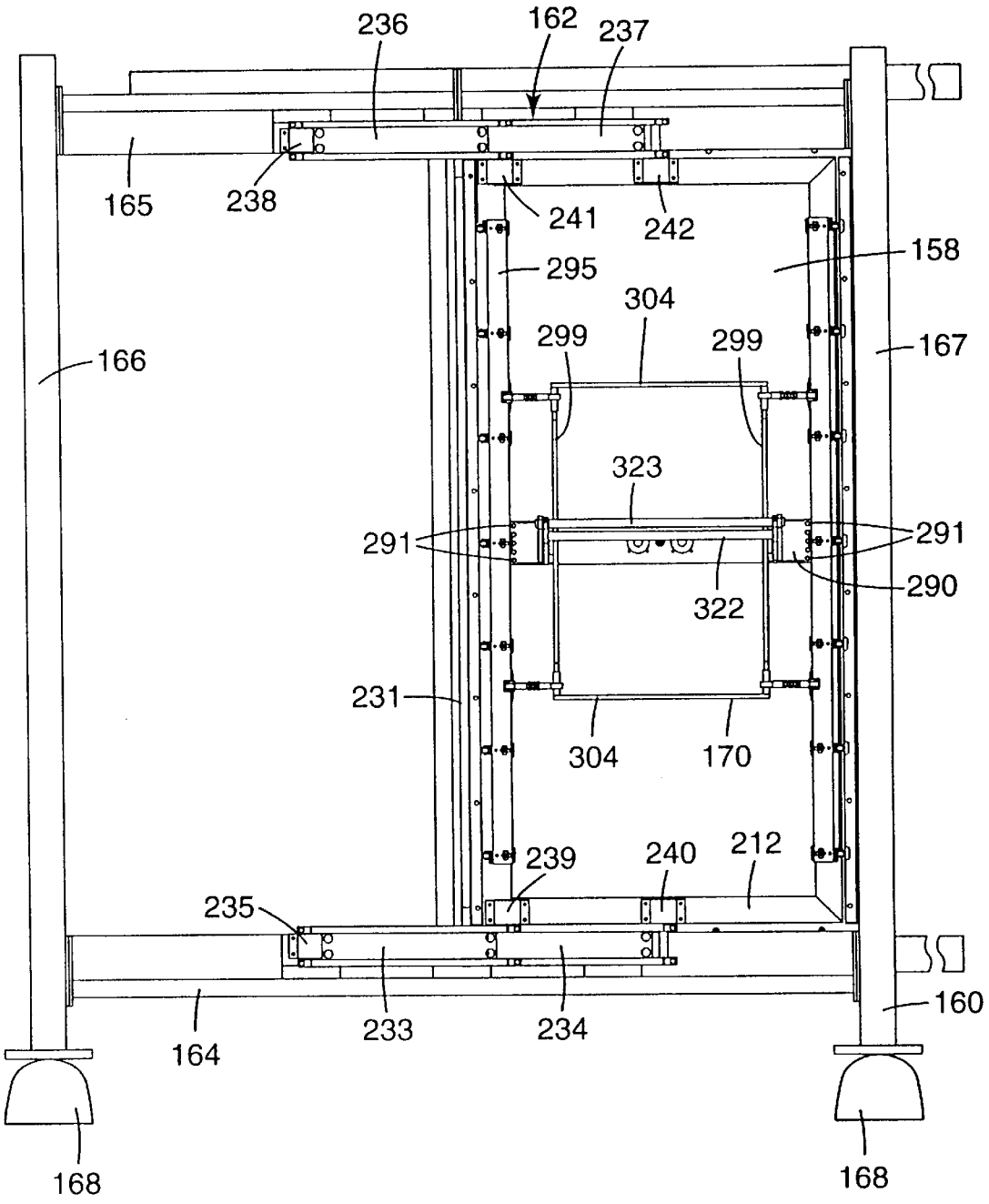
FIG. 17 is a front elevation view of the door.

The external door frame 160, as shown in FIGS. 17 and 18, comprises external frame posts 167 and 166, lower and upper beams 164 and 165 respectively and vibration damping isolation pads 168 on which the frame supports are mounted. The large beams for the door frame may be box beams.

The external door frame may be positioned and held against the enclosure by mechanical means, such as threaded rods together with nuts and clamping hardware or one or more cargo straps, like those used on large trucks, routed inside the box beams (e.g. external frame post 167) around the entire enclosure and made taught by known mechanical means. L-shaped comer protectors are placed under the strap at the comers of the enclosure. Such a cargo strap may also be used, as the nylon strap mentioned previously, to surround the bottom or the enclosure.

The hinge assembly 162, shown in FIGS. 17, 18, 22, and 23, is attached to beams 164 and 165. Bottom brace 233 is attached to lower frame beam 164 and top brace 236 is attached to upper frame beam 165 by means of bearing blocks 235 and 238 respectively. The bottom brace 233 and top brace 236 both rotate respectively about upper shaft (not shown) and a similar lower shaft (not shown) and they are also rotatably connected to links 234 and 237 respectively as shown. Links 234 and 237 are rotatably connected to movable shaft 231. Links 234 and 237 are also attached to exterior leaf frame 212 of the door leaf assembly 210 (shown in FIG. 21) by means of brackets 239–242 and fastening means within the skill of the art. Within each bracket 239–242 is a bearing block preferably comprising tapered roller bearings. By means of the hinge assembly 162, the initial movement of the door when opening, and the final movement of the door in closing is approximately perpendicular to the plane of the door frame, which leads to excellent sealing and prevents any significant shearing of the seals.

The door leaf assembly 210, as shown in FIG. 21, comprises interior leaf frame 211, exterior leaf frame 212, interior panel 214, and filler panel 215. Filler panel 215 fits within interior leaf frame 211 which fits within exterior leaf frame 212. The two leaf frames, which may be constructed of aluminum, are joined by means of screws which go through holes 216 in the exterior leaf frame and into threaded holes 219 in the interior leaf frame. The two frames 211 and 212 can be aligned by mechanical means known in the art such as alignment pins. The interior panel and filler panel are made of acoustic barrier material, preferably ACM, and they are bonded together by adhesive, e.g. VHB or epoxy adhesive. Panel 214 is somewhat smaller than panel 215 so that there is a border around the perimeter of the assembled door leaf assembly to accommodate the gasket channels 387 and 395 and gaskets. Insert 222 may be made of wood or another sound insulating material having sufficient structural integrity to support the interior latching assembly 340. It is attached to a recess in the interior panel by means known in the art, such as epoxy adhesive. This insert can receive screws used for mounting the interior latching assembly 340 by means, for example, of threaded inserts or T-nuts 223. Holes 217 and 218 in the filler and interior panels respectively are to accommodate guide 175, which is the only part which penetrates the thickness of the door. Depressions 220 are to accommodate parts of the interior latch assembly.

Foils, like those described above for the panels, are also bonded to the door panels using VHB adhesive tape. Completely covering and bonded to the side of filler panel 215 facing the inside are: foil (e.g. 10 mils thick) 224; and another layer of foil (e.g. 10 mils thick) 226. Foil layer 224 is made to surround guide 175, and a sound barrier means is employed to minimize sound penetrating holes 218 and 217. One such sound barrier means is to attach foil 224 to 381 on guide 175. Foil layer 224 extends out to cover the edges of door leaf filler panel 215 and frame 211, and gasket channel 387 is soldered to the foil. Foil layer 226 extends to the outside edge of the second (inside) gasket channel 395 shown in FIG. 20 but not FIG. 27.

Figure 24:
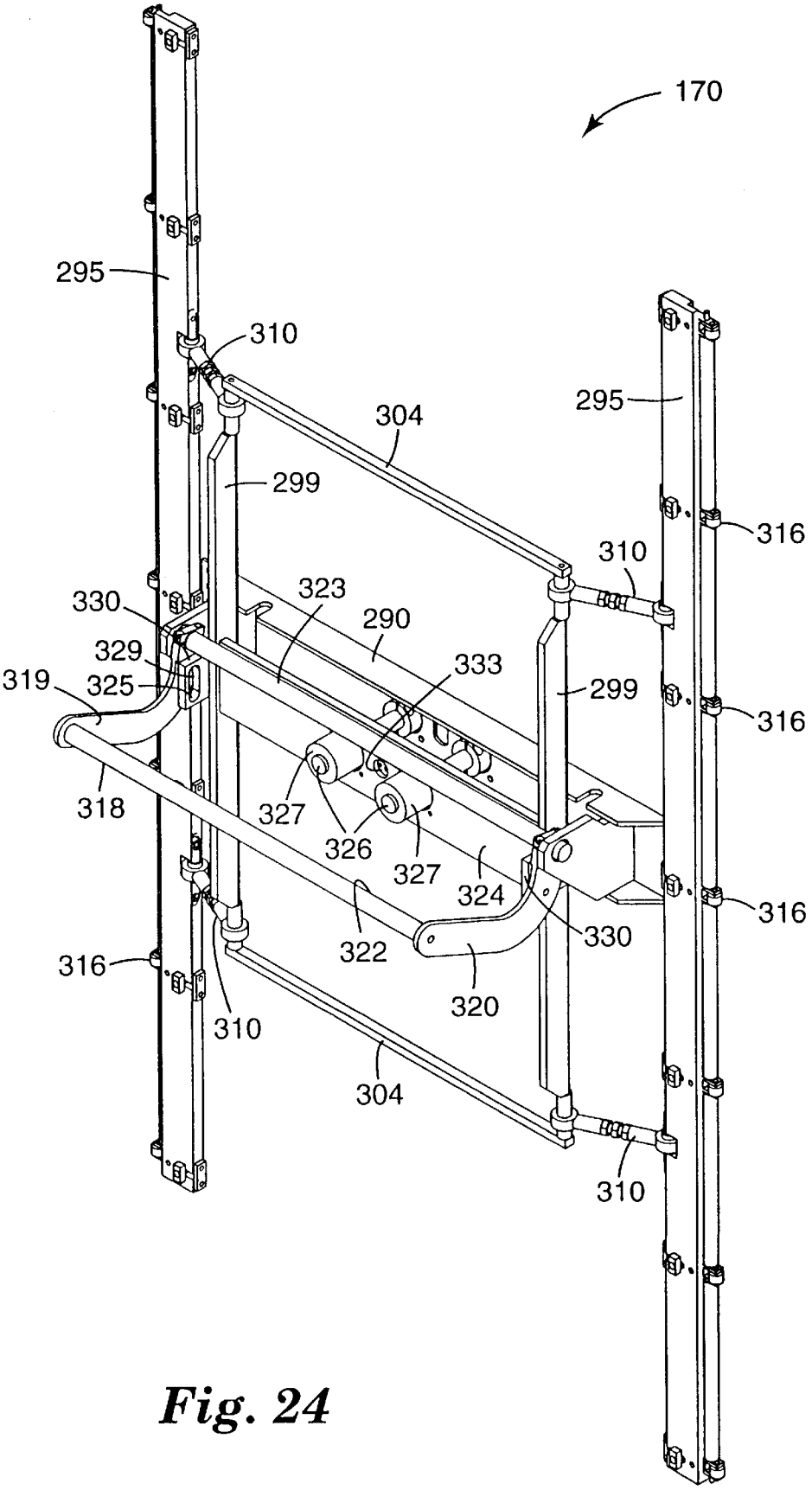
FIG. 24 is a pictorial view of the exterior latch assembly.

The exterior latch assembly 170, FIG. 24, comprises mounting channel 290, roller bars 295, lever driven bars 299, stiffening bars 304, connecting rods 310, lever 318, pivot shaft 323, guide plate guide shafts 326, and bushings 327. The mounting channel 290 is fastened to the exterior leaf frame by means known in the art, for example by screwing to plates 213 through holes 291. Rotatably mounted to the guide plate (through pivot shaft 323) is the lever 318 which comprises left lever arm 319, right lever arm 320 and lever bar 322. Guide plate 324 rests slidably on guide shafts 326 by means of bushings 327 attached to the guide plate. The guide plate is also attached to lever driven bars 299 by means known in the art. The stiffening bars 304 are attached to the tops and bottoms of the lever driven bars 299 and also to connecting rods 310 as shown in the figures. The connecting rods can comprise tensioner bolts and rod eyes connecting the lever driven bars 299 to the roller bars 295.

In operation, when the lever 318 is pushed toward the door, it pushes the guide plate 324 by means of pins 325 resting in slots or tracks 329 which are in track plates 330 which are in turn attached by means known in the art to the lever driven bars 299. The guide plate moves smoothly toward the door on guide shafts 326 by means of bushings 327. This movement causes the lever driven bars 299, which are also attached to the guide plate,.to move toward the door and push connecting rods 310. The connecting rods 310 are preferably threaded rods with threaded eyelet ends the length of which can be adjusted by means known in the art. They are adjusted to achieve the desired force of the cam rollers 316 in the clamping wedges 188. When the door is in the door frame and can move no further inward, continued pushing on the lever 318 causes the tie rods to push the roller bars 295 laterally, and the cam rollers 316 engage the indentations 189 in the door frame to close the door firmly. In the reduction to practice of this invention the door was designed to exert about 800 pounds sealing force against the door frame.

Figure 25:
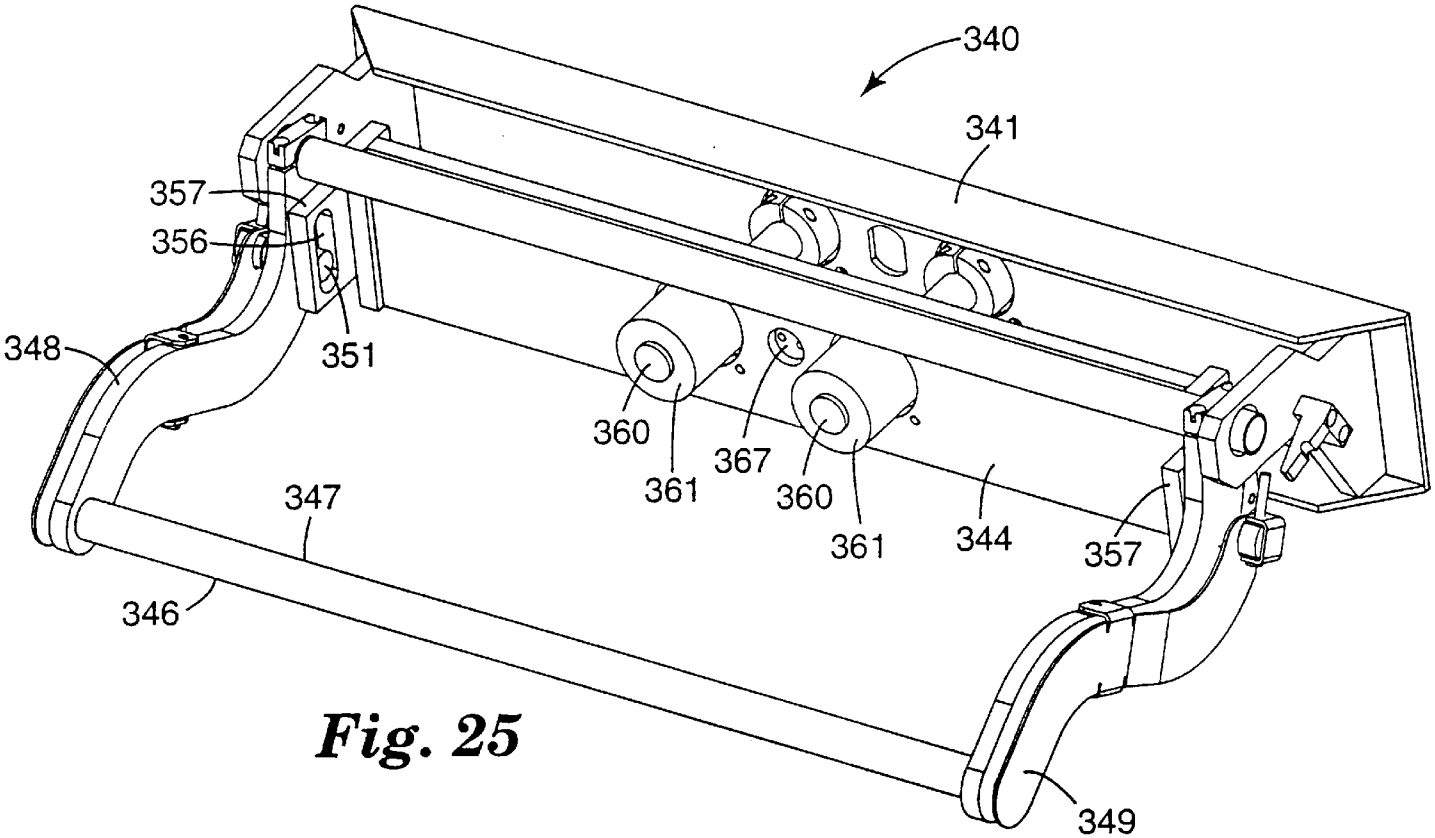
FIG. 25 is a pictorial view of the interior latch assembly.
Figure 23:
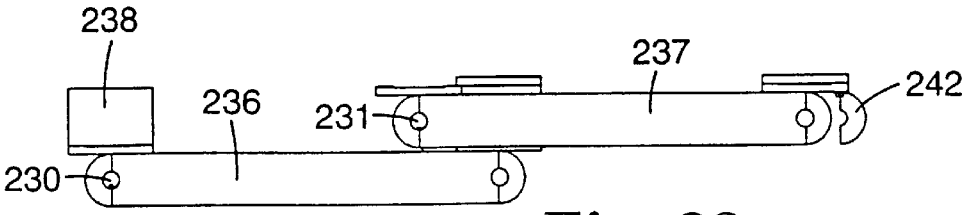
FIG. 23 is a plan or top view of the door hinge assembly.

In FIG. 25, the mounting channel 341 of interior latching assembly 340 is mounted to the insert 222 by means known in the art, such as screws threaded into inserts 223. The guide plate 344, lever 346, lever bar 347, left and right lever bars 348 and 349, pin 351, track 356, track plate 357, guide shafts 360 and bushings 361 for the interior latching assembly work in a similar way to the corresponding parts of the exterior latching assembly.

Figure 26:
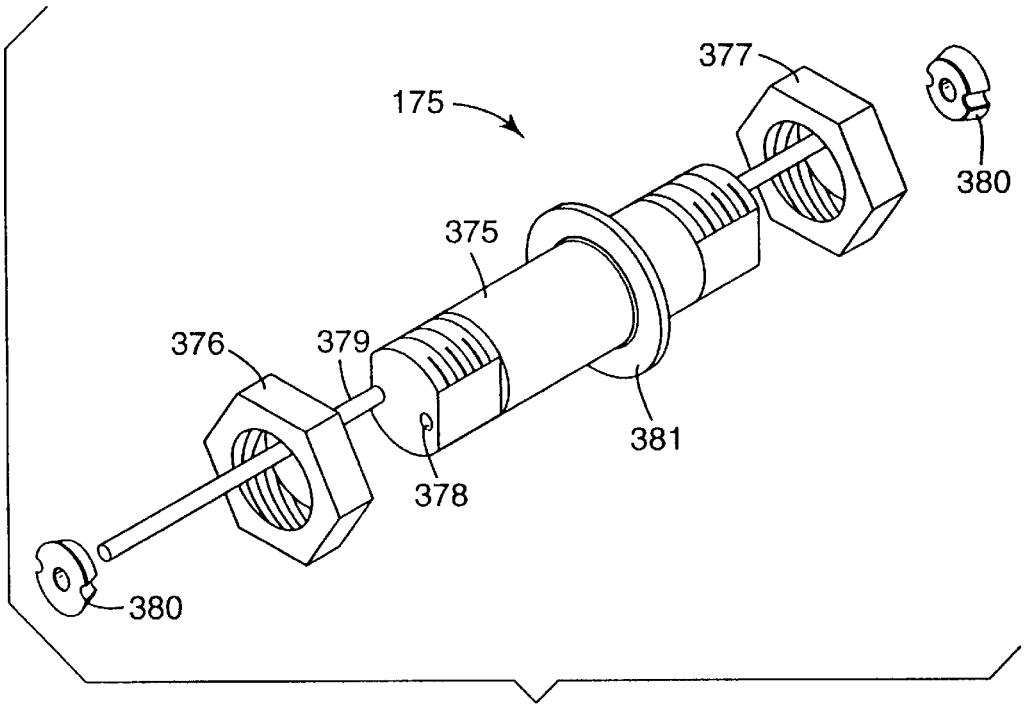
FIG. 26 is a pictorial view of the door latch guide assembly.

Holes 333 and 367 in the guide plates of the exterior and interior latching assemblies respectively accommodate guide 175 shown in FIG. 26. The guide comprises center guide 375, having integral collar 381, typically made of steel, and nuts 376 and 377. In assembling the door 210, after the door leaf frames 211 and 212 and filler panel 215 are assembled, guide 175 is inserted into hole 217. Then, collar 381 is attached to one of the foils on the interior panel 214. The nuts 376 and 377 fix the center body to mounting channels 290 and 341. One or more of center rods 379 extend through holes 378 in the center guide and slots in the retaining wedges 380 which are typically made of aluminum and inserted into specialized holes 333 and 367 in the guide plates 324 and 344. Holes 333 and 367 are countersunk into the guide plates. In the countersunk metal are formed a plurality of holes approximately in registry with center rods 379. In the center of the countersunk metal of holes 333 and 367 is formed a threaded hole for receiving a screw or bolt. The center rods are made of a strong material such as fiberglass reinforced nylon and are longer than the guide. They are fixed axially by means of wedges 380 which are placed into the countersunk holes 333 and 367 and attached by a bolt or screw inserted through the center of the wedges and threaded into the center of holes 333 and 367. The slots in wedges 380 are formed in such a way that the center rods 379 are held by friction when the wedges are firmly held by the screw or bolt just described.

When someone inside the enclosure wishes to open the door, he pushes on lever 346, which pushes on wedge 380 which causes the center rods 379 to slide within holes 378 pushing guide plate 324 outward a sufficient distance to cause the cam rollers 316 to disengage from the indentations 189 in the door frame 180. The guide 175 is the only part which penetrates completely through the door.

The door seal is attached to the door frame 180 and bears against foil 206 when the door is closed as shown in FIG. 20. There is a gap 208 in foil 206 between the areas of contact with the two seals contained in gasket channels 387 and 395.

Figure 27:
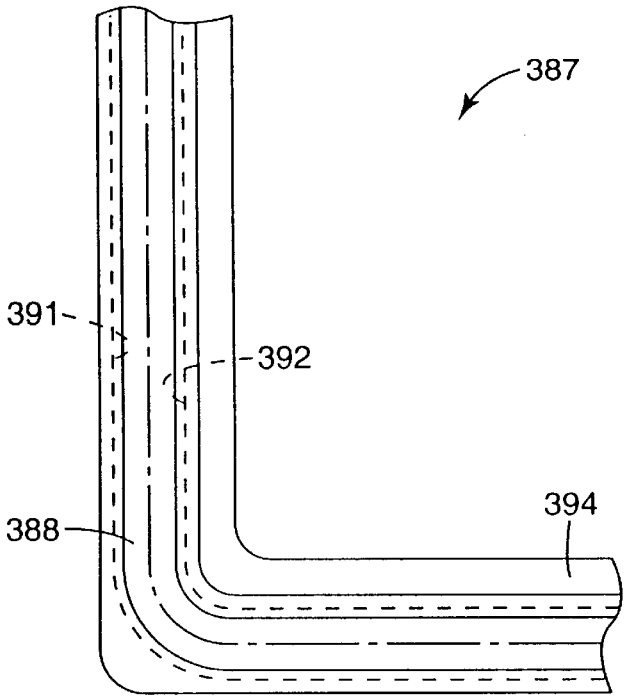
FIG. 27 is a detail of the door seal.

A pair of gasket channels 387 and 395 are fastened to foils 224 and 226 covering the interior door leaf frame 211. A detail of one such channel 387 is shown in FIG. 27. Gasket groove 388 is formed in the channel with lips 391 and 392 to hold a gasket, and the channel is also formed with land area 394 somewhat lower in elevation than lip 392. Two such channels are installed side-by-side on the door leaf frame to accommodate four gaskets surrounding the door. Only the outer channel is shown in the figure. A first gasket is inserted into gasket groove 388. A second gasket is inserted in the groove formed by the land area 394 and the adjoining gasket channel (not shown). A third gasket is installed in the gasket groove of the second or inside channel 395, and a fourth gasket is installed in the land area of the second channel.

Figure 28:
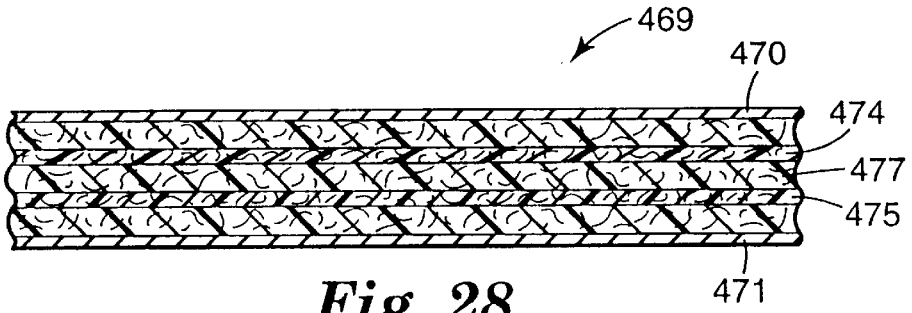
FIG. 28 is a partial sectional view of the insulation which is placed on the inside of the Walls of the enclosure.

In order to meet high and low acoustic specifications, fiberglass can be added to the interior or exterior of the inventive enclosure, and installed by means known to the art which do not affect the shielding integrity of the enclosure. FIG. 28 shows a cross section of a preferred arrangement 469 of insulation materials which would be installed next to the inside of the enclosure walls. It comprises a middle layer 477 of unfaced fiberglass insulation 1 inch (2.54 cm.) thick, flanked by two layers 474 and 475 of unfaced Microlite Premium AA insulation ⅝ (16 mm) thick. The Microlite insulation (available from Manville Corp. of Denver, Colo.) is a flexible, low density insulation, comprising resin bonded borosilicate glass fibers, designed for use where space and weight are to be minimized, which is a low density aerospace insulation. There are two outer layers 470 and 471 of 1 inch (2.54 cm) thick fiberglass insulation which are foil faced. The drawing shows these layers as two layers, the thicker layer representing the fiberglass, and the thinner one representing the aluminum foil facing. The fiberglass of layers 470, 471, and 477 typically has a density of about 6 $lbs/ft^3$ (96 $kg/m^2$). The assembly of fiberglass layers is compressed to a thickness of 4 inches (102 mm) by known means.

Figure 29:
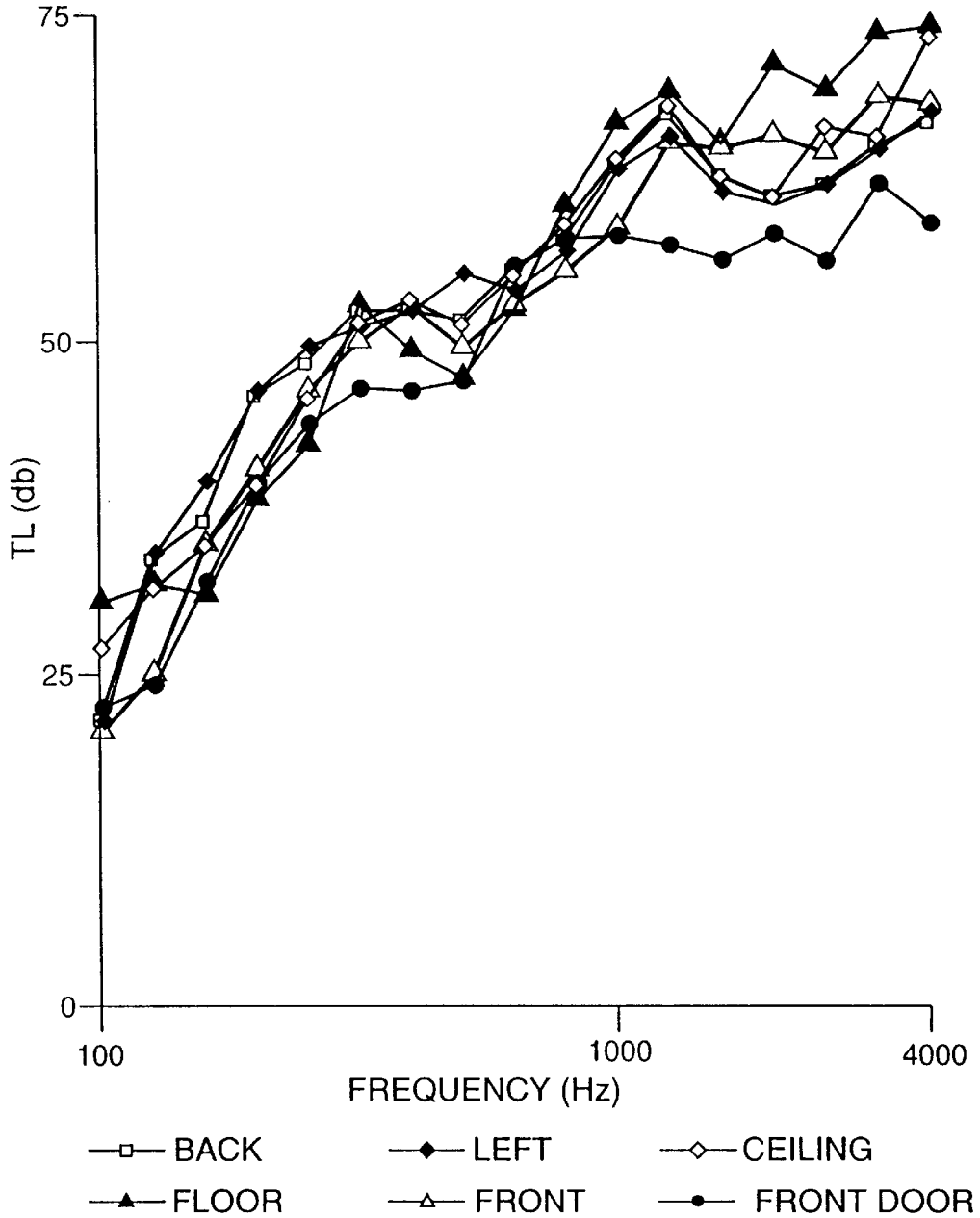
FIG. 29 is graph of acoustic transmission level (vertical axis) vs. frequency (Hz) from various locations within the enclosure.

The good acoustic attenuation properties of the enclosure are shown in the graph of FIG. 29. The drop in sound wave pressure in decibels between sound generated within the enclosure and that detected outside the enclosure is plotted against sound frequency.

The inventive enclosure can be constructed in various configurations to achieve: acoustic telephone booths; acoustic rooms; acoustic enclosures and acoustic barriers. It can be adapted to specific applications by the addition of different materials.

Some advantages of the inventive enclosure are: modular design; single wall construction; can be repaired on site; the materials (ACM) can be molded to complex shapes (for example to fit around columns); and can be constructed without soldering or bolting. Because it is constructed of block walls, the enclosure can be expanded or contracted in size by adding or subtracting blocks. The modularity of the enclosure makes it less costly to transport and install than prior known systems.

What is claimed is:

1. The combination of:

a. a panel having two major surfaces, edge portions connecting the major surfaces, and grooves in at least one edge portion, said panel being comprised of:

i) a material which is an acoustic barrier and has sufficiently high compressive and flexural strength to enable a wall to be constructed of a plurality of such panels;

ii) at least two foil layers, within and approximately congruent with one major surface of said panels, said foil layers being separated from each other by part of the thickness dimension of the panel and arranged so that they at least partially cover the grooves of each panel; and b. a mating member having a shape and dimensions which allow press fitting the mating member into a groove of the panel of part a., said mating member each being a single piece and comprising:

i) a material which is an acoustic barrier having sufficiently high Young's modulus and compressive strength to allow a wall to be constructed of a combination of panels and mating members without fasteners which penetrate the panels or mating members; and ii) at least two foil layers at least partially covering the sides of the mating member, in such a way that when the mating member is inserted into the groove of the panel, the respective foil layers in the panel groove and on the mating member are in sliding contact with each other.

* * * * *